US012168930B2

(12) United States Patent
Xu et al.

(10) Patent No.: US 12,168,930 B2
(45) Date of Patent: Dec. 17, 2024

(54) SHORT-RADIUS DRILLING TOOL, TRACK-CONTROLLABLE LATERAL DRILLING TOOL AND METHOD

(71) Applicant: Xiaoyue Wan, Beijing (CN)

(72) Inventors: Zichen Xu, Beijing (CN); Zhonghua Yang, Beijing (CN); Xiaoyue Wan, Beijing (CN)

(73) Assignee: Xiaoyue Wan, Beijing (CN)

( * ) Notice: Subject to any disclaimer, the term of this patent is extended or adjusted under 35 U.S.C. 154(b) by 0 days.

(21) Appl. No.: 18/032,406

(22) PCT Filed: Oct. 19, 2021

(86) PCT No.: PCT/CN2021/124796

§ 371 (c)(1),
(2) Date: Aug. 28, 2023

(87) PCT Pub. No.: WO2022/083602

PCT Pub. Date: Apr. 28, 2022

(65) Prior Publication Data

US 2024/0263518 A1 Aug. 8, 2024

(30) Foreign Application Priority Data

Oct. 19, 2020 (CN) ..... 202011119606.9
Nov. 27, 2020 (CN) ..... 202011358655.8
(Continued)

(51) Int. Cl.
*E21B 7/06* (2006.01)
*E21B 17/20* (2006.01)
*E21B 47/12* (2012.01)

(52) U.S. Cl.
CPC ..... *E21B 7/06* (2013.01); *E21B 17/20* (2013.01); *E21B 47/12* (2013.01)

(58) Field of Classification Search
CPC ..... E21B 7/06; E21B 17/20; E21B 47/12
See application file for complete search history.

(56) References Cited

U.S. PATENT DOCUMENTS 2,441,881 A * 5/1948 Hays ..... E21B 17/20
175/394
2,515,366 A * 7/1950 Zublin ..... E21B 7/06
175/320

(Continued)

FOREIGN PATENT DOCUMENTS

CN 109854174 * 6/2019 ..... E21B 7/04

OTHER PUBLICATIONS

Written Opinion of PCT English (Year: 2023).*
English translation of CN 109854174 (Year: 2019).*

*Primary Examiner* — Steven A MacDonald
(74) *Attorney, Agent, or Firm* — Harness, Dickey & Pierce, P.L.C.; Anthony G. Fussner

(57) ABSTRACT

A short radius drilling tool and a trajectory-controllable lateral drilling tool and method, including a lateral drilling section with high passing ability and a power transmission section, wherein the lateral drilling section with high passing ability can drill the extension well section of a short to ultra-short radius well section that extends laterally from a main wellbore. The designed trajectory-controllable lateral drilling tool allows a wellbore to be subjected to directional drilling with a short to ultra-short radius from a tail end or any position of the original wellbore trajectory, and then implements lateral extension drilling. Furthermore, the device has engineering feasibility and practical value for thin reservoir exploitation, remaining oil potential tapping, exploitation of horizontal wells in sub-salt reservoirs, combined exploitation of thin interbed, coalbed methane exploitation, underground gasification exploitation of coal mine, (Continued)

unconventional oil and gas exploitation, (seabed) shallow horizontal well drilling, and exploitation of other minerals.

23 Claims, 12 Drawing Sheets

(30) Foreign Application Priority Data

Jan. 20, 2021 (CN) ..... 202110075355.7
Jan. 20, 2021 (CN) ..... 202110076907.6

(56) References Cited

U.S. PATENT DOCUMENTS 2,684,581 A * 7/1954 Zublin ..... E21B 17/20 285/39
3,958,649 A * 5/1976 Bull ..... E21B 7/061 464/21
4,051,908 A * 10/1977 Driver ..... E21B 7/061 175/78
4,153,119 A * 5/1979 Edmond ..... E21B 17/20 173/79
4,328,839 A * 5/1982 Lyons ..... E21B 17/20 403/339
4,442,908 A * 4/1984 Steenbock ..... E21B 4/00 175/73
4,456,080 A * 6/1984 Holbert ..... E21B 17/1078 175/323
4,484,641 A * 11/1984 Dismukes ..... E21B 17/05 175/74
4,658,916 A * 4/1987 Bond ..... E21B 7/061 175/323
4,699,224 A * 10/1987 Burton ..... E21B 17/10 175/73
4,880,067 A * 11/1989 Jelsma ..... E21B 4/02 175/320
4,964,474 A * 10/1990 Poesch ..... E21B 19/22 175/73
5,007,487 A * 4/1991 Dahle ..... E21B 19/08 175/203
RE33,660 E * 8/1991 Jelsma ..... E21B 4/02 175/320
5,085,283 A * 2/1992 Seabourn ..... F16C 1/06 175/323
5,538,092 A * 7/1996 Precopia ..... E21B 19/22 175/320
5,679,894 A * 10/1997 Kruger ..... E21B 47/06 73/152.01
5,699,866 A * 12/1997 Cousins ..... E21B 7/068 175/78
5,702,653 A * 12/1997 Riley ..... H01C 17/06513 156/89.12
6,378,629 B1 * 4/2002 Baird ..... E21B 17/20 175/81
7,810,586 B2 * 10/2010 Cousins ..... E21B 17/046 175/320
10,787,866 B2 * 9/2020 Thomas ..... E21B 23/14
2004/0039466 A1 * 2/2004 Lilly ..... H04L 45/24 700/95
2008/0115940 A1 * 5/2008 Brunet ..... E21B 7/046 166/55.1
2016/0108679 A1 * 4/2016 Bayliss ..... E21B 7/068 175/45
2018/0328118 A1 * 11/2018 Morse ..... E21B 10/5673
2020/0300061 A1 * 9/2020 Iguaz ..... E21B 23/12
2021/0087884 A1 * 3/2021 Cardon ..... E21B 17/1085
2022/0316279 A1 * 10/2022 Wan ..... E21B 41/0035

* cited by examiner

SHORT-RADIUS DRILLING TOOL, TRACK-CONTROLLABLE LATERAL DRILLING TOOL AND METHOD

CROSS REFERENCE TO RELATED APPLICATIONS

This application claims priority to Chinese Patent Application No. 202110076907.6, filed on Jan. 20, 2021, and entitled 'Trajectory-controllable Lateral Drilling Tool and Method';

this application also claims priority to Chinese Patent Application No. 202110075355.7, filed on Jan. 20, 2021, and entitled 'High-stability Trajectory-controllable Flexible Drilling Tool and Method';

this application also claims priority to Chinese Patent Application No. 202011119606.9, filed on Oct. 19, 2020, and entitled 'Trajectory-controllable Lateral Drilling Tool and Method'; and this application also claims priority to Chinese Patent Application No. 202011358655.8, filed on Nov. 27, 2020, and entitled 'Short Radius Drilling Tool'.

TECHNICAL FIELD

The present disclosure relates to the fields of drilling technology and oil and gas extraction, and in particular to a short radius drilling tool, and a trajectory-controllable lateral drilling tool and method.

BACKGROUND ART

The reduction of production costs has always been a goal pursued in oil and gas drilling. With the development of unconventional oil and gas fields, the requirements for drilling equipment are getting higher and higher, and an automated, intelligent and efficient drilling technology has become the mainstream for reducing costs and improving efficiency. In addition, the drilling technology is also massively applied to the fields such as geological engineering and mineral exploitation.

The application background of this technology lies in the sidetracking of branch wells with a short to ultra-short radius at any position in the existing main wellbore, and then continuing to extend branch wellbores in a direction different from a main wellbore axis, or extending the wellbores in a direction different from the main wellbore axis at a tail end of the existing wellbore by using a short to ultra-short radius deflection technology. Generally speaking, the range of short radii is 10-60 meters. According to the present disclosure, a meter-level range is defined as the scale range of extremely short radii, which can be understood as a turning radius of a whipstocking section of an extremely short radius well being less than 10 meters.

At present, a coiled tubing is employed to transmit a screw motor with a bent joint, which can implement medium and short radius trajectory-controllable sidetrack drilling. However, the directional method is slide guiding. An entire drill pipe does not rotate. A drilling circulating medium drives a screw to drive a drill bit to rotate. The well deflection and azimuth performance of a drilling tool are changed by the change of a tool face angle of a bent joint. There are restrictions such as the drilling tool being not capable of rotating during a directional operation and having the failure in completion of a short-radius directional drilling operation, and the like, so that the wellbore trajectory accuracy is poor. Moreover, since the coiled tubing has the inherent disadvantages such as non-rotation and low strength, a tubing string is prone to damage and fracture, and thus is not suitable for bearing a high torque. The diameter of a drilled wellbore is too small to meet the basic requirements of oil and gas reservoir development for the flow conductivity of oil and gas wells. Therefore, the coiled tubing is almost unable to perform short-radius lateral drilling, and cannot work in the scope of ultra-short radius and extremely-short radius lateral drilling.

Another way to implement short to ultra-short radius lateral drilling is to drive a drill bit to drill by means of a flexible drill rod so as to achieve short to ultra-short radius lateral drilling. That is, single short drill rods with lengths of less than 1.5 meters are connected in series to form the flexible drill pipe. A tensile force is transmitted among the short drill pipes by means of ball heads and ball bowls. Torques are transmitted by means of splines provided between the ball heads and the ball bowls. A flexible drill pipe is adopted to drive the bottom drill bit to rotate so as to realize rock breaking. This method can rely on a directional drilling effect of a directional tool to implement the short to ultra-short radius lateral drilling, but cannot control a wellbore trajectory and cannot obtain a wellbore trajectory with a certain accuracy in a process of further wellbore extension, so that the bending of the wellbore is serious, the drilling of the drill bit is hindered, and it is also difficult for the wellbore trajectory with uncontrollable distortion to meet on-site demands.

In addition, for the exploitation of many oil and gas reservoirs or solid mineral resources that require fluidized mining, drilling technologies and even horizontal well drilling technologies are required. Since the existing directional drilling technology cannot achieve short-radius steering, it is difficult to exploit ultra-thin reservoirs, or it is difficult for directional drilling in caprock, but a directional well with large curvature steering is required after entering the reservoir, or branch drilling is implemented as much as possible, or wide-angle turns are realized in shallow formations, or the utilization of reserves beside a well can be realized by sidetracking branch wells in the existing wellbores. In the prior art, screw drilling tools with bent joints are usually used to drill the branch wells to realize the utilization of reserves beside a well. The existing data shows that the existing directional drilling technology adopting the screw drilling tool and other directional drilling technologies cannot break through the angle building hole rate of 15°/30 meters. To sum up, the existing trajectory-controllable directional drilling technology cannot realize high curvature deflection. If the wellbore curvature is too small, directional drilling sections will be too long, and turning well sections will produce a great deal of invalid drilling footage. Therefore, the economic benefit is poor and the operation difficulty of construction well sections is increased.

SUMMARY OF THE INVENTION

The purpose of the present disclosure is to provide a short radius drilling tool, a trajectory-controllable lateral drilling tool, and a method for drilling short to ultra-short radius well sections laterally from the bottom or any other location of the main wellbore, so that the controlled trajectory can be extended.

The above purpose of the present disclosure can be achieved by the following technical solution:

The present disclosure provides a trajectory-controllable lateral drilling tool, which includes a high passage lateral drilling section and a power transmission section. The lateral drilling section with high passing ability can drill the extension well section of the short to ultra-short radius well section that extends laterally from the main wellbore. From the front to back, the lateral drilling section with high passing ability sequentially includes a drill bit, a steering short pup joint with high passing ability, and a transmission short pup joint array with high passing ability. The transmission short pup joint array with high passing ability is composed of several transmission short pup joints used to bear torque. The transmission short pup joints can provide the rotary drilling power to the drill bit and have a preset deflection limit between each adjacent transmission short pup joint. The transmission short pup joint array with high passing ability is provided with a through structure along its own axis direction to form a main flow channel for the drilling circulating medium to flow.

The present disclosure provides a trajectory-controllable lateral drilling method, including the following steps:

Step 1: The short to ultra-short radius directional drilling tool includes a flexible drill rod and a high directional drilling bit. Using a conventional drilling pipe, the high directional drilling bit is driven by a specific length of the flexible drill rod to complete the lateral drilling of the short to ultra-short radius well section under the influence of the oblique force provided by the directional tool and the WOB. The length of the flexible drill rod and the high directional drilling bit is not less than the length of the short to ultra-short radius well section.

Step 2: Retrieve the flexible drill rod and the high directional drilling bit, and insert the trajectory-controllable lateral drilling tool to complete the drilling of the extension section through the short to ultra-short radius well section. The directional tool can support the trajectory-controllable lateral drilling tool within the main wellbore, and the length of the lateral drilling section with high passing ability is greater than the sum of the length of the short to ultra-short radius well section and the extension part in wellbore section.

The present disclosure provides a variable azimuth trajectory-controllable lateral drilling method, including the following steps:

Step 1: Insert the oblique tool, so that the directional drilling surface of the directional tool faces the azimuth direction of the main wellbore. The drilling bit can face the azimuth direction of the main wellbore to achieve window-opening operations.

Step 2: Use a flexible drill rod to drive the high directional drilling bit to laterally drill the short to ultra-short radius well section along the azimuth direction of the main wellbore to a pre-designed wellbore inclination angle. The azimuth direction of the short to ultra-short radius deviated section is generally consistent with the azimuth direction of the main wellbore.

Step 3: Change the azimuth direction of the extension section gradually to meet the requirements during the drilling operation of extension sections.

The present disclosure provides a short radius drilling tool, which includes a steering short pup joint. The steering short pup joint includes a drill bit and a steering pup joint. The steering pup joint includes a supporting body on which a steering mechanism and an electrically driven actuator are installed. The drill bit is connected to the lower end of the supporting body, and the steering mechanism can drive the drill bit to deflect in an expected direction. The tool also includes a driving drill pipe comprising multiple supporting short pup joints connected sequentially from top (back) to bottom (front). The supporting short pup joint located at the bottom is connected to the supporting body, and the adjacent supporting short pup joints and the supporting body are all hinge jointed by a WOB and torque deflection transfer mechanism. The driving control short pup joint is equipped with an electrically driven actuator driving control circuit. The electrically driven actuator driving control circuit is electrically connected to the electrically driven actuator via crossover cables. The driving control short pup joint is connected between the steering short pup joint and the driving drill pipe, or at any position within the drill pipe, or at the upper end of drill pipe. The length of the supporting short pup joints is less than 1.2 meters.

The highlight and advantages of the present disclosure are stated as follows:

1. In the present disclosure, directional drilling can be achieved under the condition of short radius drill pipe rotation through a transmission short pup joint array with high passing ability, effectively solving the problem of wellbore extension in short to ultra-short radius wells. It has engineering feasibility and practical value for the combined development of multi-layer oil and gas resources, development of thin hydrocarbon resource layers, residual oil recovery, coal-bed methane development, and development of other types of minerals with short-radius directional drilling technology.

2. In the present disclosure, WOB and torque transmission and communication within the ultra-short radius wellbore are achieved through a transmission short pup joint array with high passing ability equipped with electrical lines passing through transmission short pup joints. The electrical lines passing through transmission short pup joints are electrically connected to the relay communication device, and the communication device achieves relay information transmission between down-hole electrical devices near the drilling bit and the wellhead, so that the steering short pup joint with high passing ability does not need to complete long-distance communication tasks but can instead delegate them to the relay communication short pup joints, significantly reducing the distance between each deviation point. As relay communication short pup joints are generally mud pulse transducers and require a lot of space, the advantage of the present disclosure is in reducing the risk of encountering obstacles during drilling and solving the problem of length limitation of the relay communication short pup joints. Moreover, the length of each transmission short pup joint in the transmission short pup joint array with high passing ability is strictly limited, so the near-drilling bit electrical device should not include devices that can achieve long-distance communication. In the case where the controllable WOB and torque transmission short pup joint array needs to be connected to the wellhead through a long-distance drill rod, the present disclosure device achieves relay communication through a relay communication device, allowing the near-drilling bit electrical device including electrical actuators and gamma measurement modules to communicate at close range across several transmission short pup joints and the relay communication device in a space-constrained environment. Furthermore, the relay communication device achieves long-distance communication from the relay location to the wellhead with stronger energy, ultimately achieving communication from the near-drilling bit electrical device, including the measuring circuit, to the wellhead and completing trajectory-controllable lateral drilling across short-ultra-short radius well sections. By means of the electrical line passing through the transmission short pup joints, the functions of each short pup joint are effectively dispersed, allowing the steering short pup joint with high passing abilities to perform the guiding function and ensuring that the short pup joints responsible for power supply and communication with the wellhead do not enter the short-ultra-short radius well sections, so that each short pup joint has only a single function within the system. This greatly reduces the length and volume of any short pup joint, improves the power transmission stability and electrical line safety of the transmission short pup joint array with high passing ability, and facilitates the instrument's adaptation to higher curvature wellbores while completing the directional drilling task of the short-radius wellbore. The WOB and torque transmission and rotational power transmission are achieved in the short-radius well sections through an array of transmission short pup joints that limit the rotational deflection angle, thereby completing trajectory-controllable lateral drilling across short-ultra-short radius well sections.

3. The present disclosure solves the following bottlenecks that hinder the trajectory-controllable lateral drilling tool and its transmission short pup joint array with high passing ability from functioning by placing a relay communication device at the input end of the transmission short pup joint array with high passing ability. As the relay communication device generally contains a mud pulse transducer, it generates strong pressure pulses that can damage the flexible conduit under pressure from water jets. Therefore, the relay communication device used for communication with the wellhead end via the drill pipe formed by conventional drill rods should be placed at the rear of the transmission short pup joint array with high passing ability (the direction of the drill bit is forward). During the rotary drilling process, frequent collisions occur between the drill pipe and the wellbore wall, and the low stiffness of the WOB and torque transmission section exacerbates both the intensity and instantaneous frequency of the drill pipe vibrations and the occurrence of violent instant impacts. The intense vibrations can reach 10-50 times the gravitational acceleration, and the instant impacts can reach 100-500 times the gravitational acceleration. Therefore, to effectively ensure the communication quality between the relay communication device and the wellhead end, as well as the stability of the electronic components in the relay communication device, placing the relay communication device at the input end of the transmission short pup joint array with high passing ability has great benefits for improving the safety and stability of the tool. As any deflection point of the WOB and torque transmission array is a relatively weak link of the trajectory-controllable lateral drilling tool, placing the relay communication device at the input end of the transmission short pup joint array with high passing ability also has great benefits for reducing the tool's lost-in-hole incidents.

4. Due to the working principle of the steering short pup joint with high passing ability, which relies on the hydraulic piston to push against the borehole wall for guidance, the stability of the steering short pup joint with high passing ability is severely compromised by the transmission short pup joint array with high passing ability. In order to maintain the coaxial characteristics of the steering short pup joint with high passing ability for effective and stable operation of the hydraulic piston, the present disclosure innovatively uses a straightening device to reduce the problems of the steering short pup joint with high passing ability caused by the bending of the transmission short pup joint array with high passing ability, thereby providing a good and stable working environment for the hydraulic piston. In addition, the straightening device can suppress the severe vibration, impact force, and damage to the wellbore caused by the transmission short pup joint array with high passing ability behind the transmission short pup joint array with high passing ability in the wellbore.

5. The advantage of using thick-film circuit technology to fabricate measuring circuits is that it can minimize the size of the measuring circuit and improve the vibration resistance performance of the measuring circuit.

6. During the ultra-short radius lateral drilling process using the trajectory-controllable lateral drilling tool of the present disclosure, the trajectory-controllable lateral drilling tool is introduced into the window by an anchor guiding device. The drilling equipment at the wellhead applies WOB and drives a conventional drill pipe to rotate, thus driving a transmission short pup joint array with high passing ability to rotate. Meanwhile, the steering short pup joint is driven to deflect the drill bit to achieve the feedback adjustment of the drilling trajectory. In this operating environment, the windows on the casing wall can easily cause the tool to get stuck, so in the present disclosure, the power short pup joints and/or relay communication devices are set behind the transmission short pup joint array with high passing ability. This can avoid excessive instrumentation entering the window during the operation of the short radius branch well, greatly reducing the possibility of the tool getting stuck.

7. In the device of the present disclosure, by limiting the distance between adjacent universal joints in the transmission short pup joint array with high passing ability to less than 5 times the diameter of the drill bit, the distance between each articulation point can be reduced. When the transmission short pup joint array with high passing ability vibrates, there will not be excessively long lever arms formed on either side of each articulation point, which could cause the articulation point to break. The maximum deflection angle between adjacent transmission short pup joints in the transmission short pup joint array with high passing ability is not more than 8 degrees. The maximum deflection angle is the mechanical limit of the power transmission short pup joint angle for WOB and torque transfer, which prevents excessive bending of the transmission short pup joints in the transmission short pup joint array with high passing ability during WOB and torque transmission. This also helps prevent damage to the electrical circuitry through the transmission sections. The distance from the drill bit to the output end rotation center of the transmission short pup joint array with high passing ability should not exceed 1.5 meters. Alternatively, the minimum distance between the deflection centers of any two transmission short pup joints in the transmission short pup joint array with high passing ability should not exceed 1 meter so that the section between the drill bit and the top transmission short pup joint can achieve sufficient curvature for short radius well drilling and maximum directional drilling. Additionally, under the same directional drilling performance conditions or high curvature wellbore passability conditions, shortening the length of each transmission short pup joint, i.e., shortening the distance between two deflection points, can reduce the deflection limit of each deflection point. This can protect the transmission short pup joint from damage and reduce underground vibrations, especially protecting the universal joint used for transmitting rotating drilling power in the transmission short pup joint. In the present disclosure, the relative positions and diameters of the articulation points, hydraulic piston subassembly, and drill bits for both the steering short pup joint with high passing abilities for the front piston and the steering short pup joint with high passing abilities for the rear piston are limited to meet the requirements of high curvature wellbores for the tool's passage.

8. As described above, the design of the rear piston pushing device can fully utilize the space of the steering short pup joint with high passing ability to minimize its length. Specific size restrictions in the present disclosure ensure that the steering short pup joint with high passing ability can effectively perform its guiding function.

9. In the drilling process of the present disclosure, the high directional drilling section is drilled by using the flexible drill rod to drive the high directional drilling bit, and then the lateral drilling of the extended wellbore section is achieved by the trajectory-controllable lateral drilling tool of the present disclosure. The short to ultra-short tool combination for high directional drilling, such as the one described in CN1464170A, is achieved by using the existing flexible drill rod and high directional drilling bit, utilizing their characteristics in achieving directional drilling to complete the drilling g of short to ultra-short radius wellbores. Furthermore, the trajectory-controllable lateral drilling tool of the present disclosure, which features directional drilling under rotary conditions, is used to complete the short to ultra-short radius directional drilling wellbore segment and the extended wellbore segment separately, thus avoiding the problem of not being able to simultaneously achieve high directional drilling with ultra-short radius and wellbore trajectory extension with any single combination of drill tools. The main advantage of the present disclosure is that it can continue drilling on the basis of a preset short to ultra-short radius wellbore, and achieve the drilling of an extended wellbore with controlled trajectory. Therefore, the requirement for the ability of steering short pup joint with high passing abilities in the directional drilling is greatly reduced.

10. For the situation where the design azimuth of the extended wellbore does not match that of the main wellbore, the present disclosure proposes a two-stage trajectory-controllable lateral drilling method with variable azimuth. The present disclosure ingeniously uses the directional drilling-friendly characteristics of the short to ultra-short tool directional drilling combination to achieve short to ultra-short radius drilling along the azimuth direction of the main wellbore, and complete the short to ultra-short radius wellbore with the shortest footage possible. Then, the trajectory-controllable lateral drilling tool is used to achieve changes in the wellbore azimuth of the extended wellbore segment, relying on its characteristic of directional drilling under rotary drilling conditions. This avoids the problem of not being able to simultaneously achieve high directional drilling with ultra-short radius and wellbore trajectory extension with any single combination of drill tools.

11. The short radius drilling tool of the present disclosure drives the drill bit to deviate in expected directions by setting a steering mechanism under rotating conditions. This mechanism changes the wellbore trajectory, thus achieving directional drilling with short to ultra-short radius or completing directional drilling of the extended wellbore segment through short to ultra-short radius wellbore drilling. By placing the electric driver actuator driving control circuit containing numerous power devices requiring heat dissipation space within a driving control short pup joint behind the supporting body, the steering pup joint contains only the steering mechanism and the electrically driven actuator, thereby effectively shortening the length of the steering pup joint and making it easier to achieve directional functionality in high-curvature wellbores.

12. The present disclosure selects an electrically driven actuator to drive the hydraulic cylinder and distribute the drilling circulating medium in the through-flow channel to achieve guidance in a specific direction. This can maximize the energy savings required for the guidance process and is crucial in reducing the volume of the mechanical structure and circuitry.

13. The strapdown attitude measurement module can measure the attitude of the short radius drilling tool without relying on an inertial platform, eliminating the need for a large amount of space occupied by the inertial platform and the potential hazards it brings. This helps to miniaturize the supporting body or supporting short pup joints of the short radius drilling tool.

14. The advantage of setting both the guidance control circuit and the electrically driven actuator driving control circuit inside the electrically driven actuator driving control short pup joint is that the guidance control circuit can more quickly and agilely control the switch tube driver through the PWM signal, and further control the electrically driven actuator by driving the switch tube through the switch tube driver, greatly reducing the possibility of interference in the control chain. The switch tube can be an IGBT (Insulated Gate Bipolar Transistor) or MOSFET (Insulated Gate Field Effect Transistor), etc.

BRIEF DESCRIPTION OF THE DRAWINGS

The following accompanying drawings are only intended to schematically illustrate and explain the present disclosure, and do not limit the scope of the present disclosure. In the drawings.

DETAILED DESCRIPTION OF THE DISCLOSURE

Figure 1:
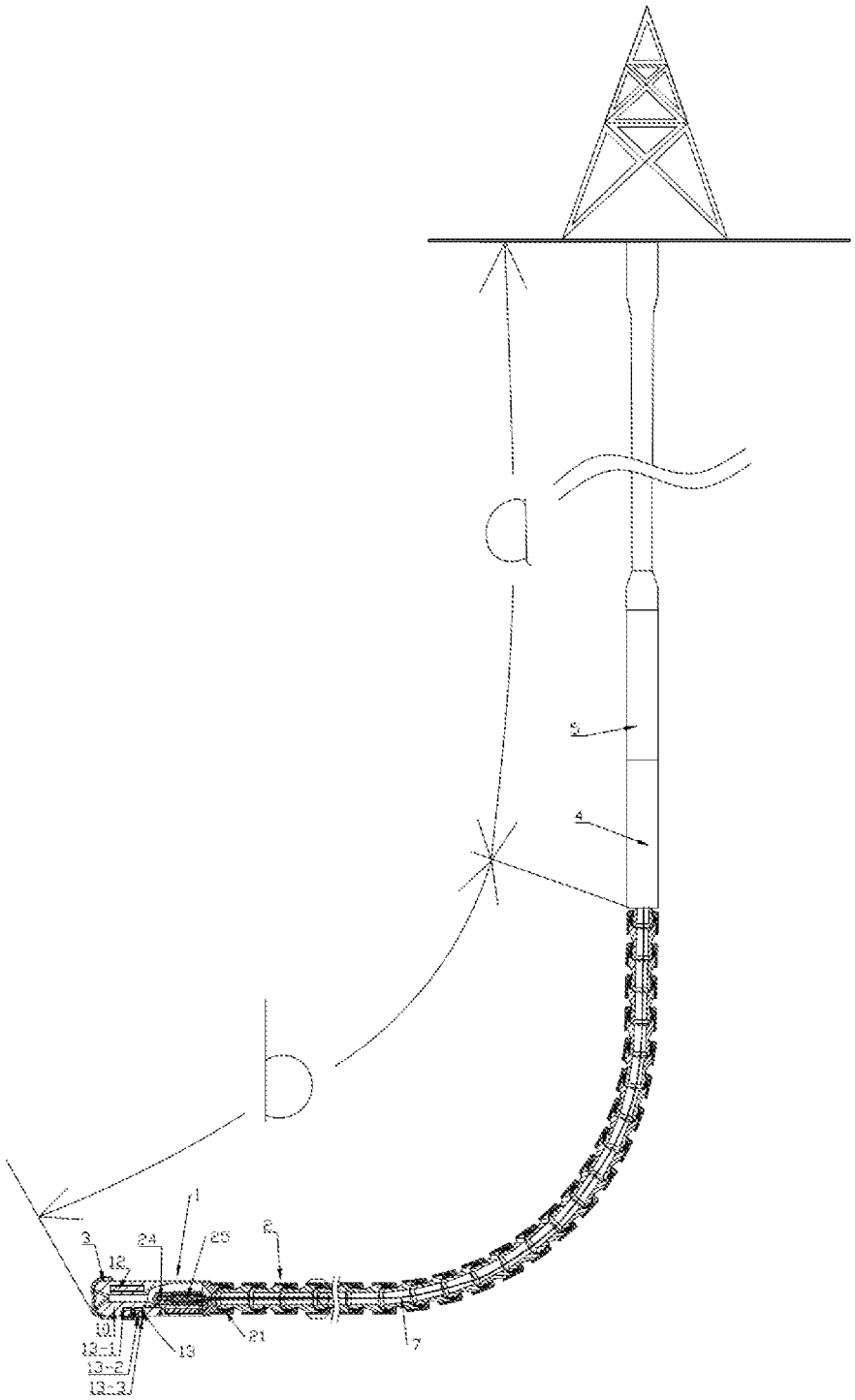
FIG. 1 is a schematic diagram of the overall structure of a trajectory-controllable lateral drilling tool.
Figure 2:
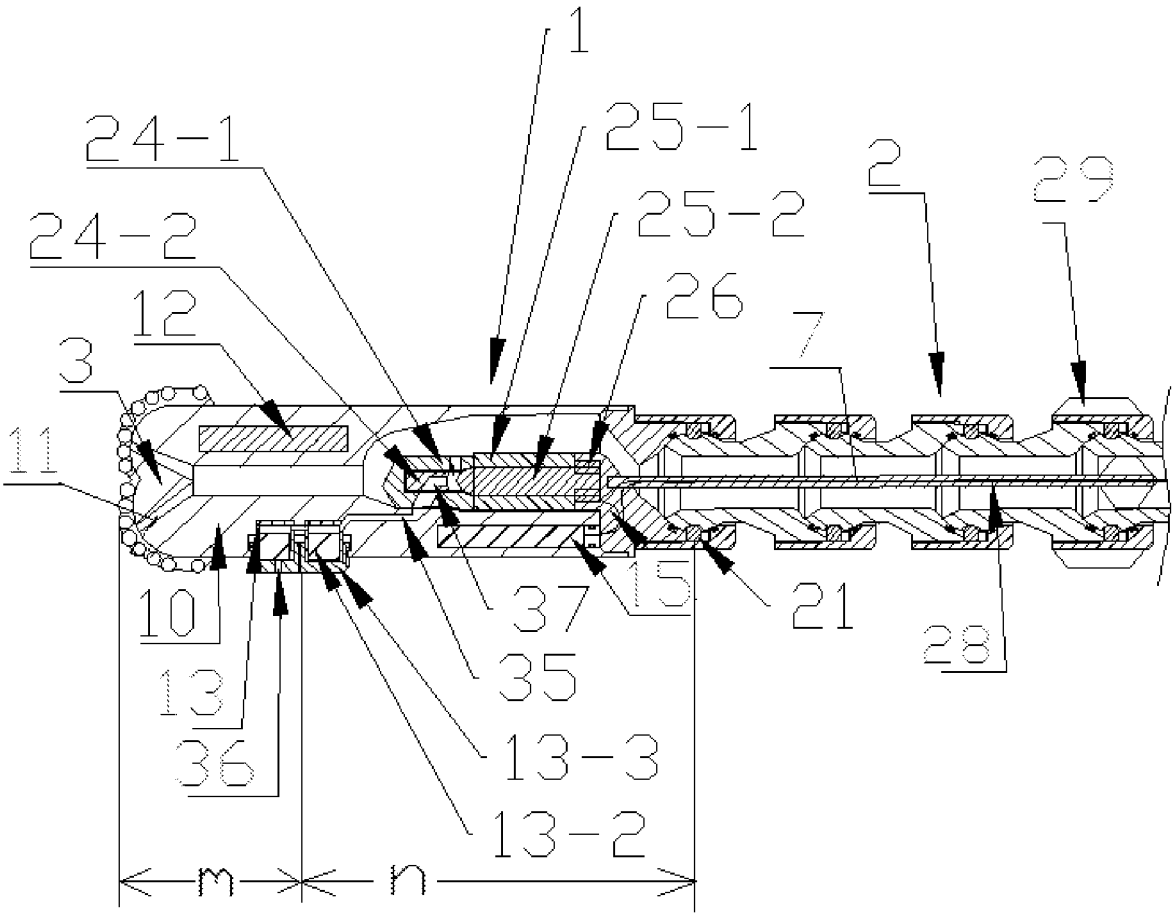
FIG. 2 is a schematic diagram of a steering short pup joint with high passing ability.

In order to have a clearer understanding of the technical features, objectives, and effects of the present disclosure, the specific embodiments of the present disclosure are explained with reference to the accompanying drawings. In the description of the present disclosure, unless otherwise indicated, "multiple" means two or more.

FIGS. 1-10 and their accompanying reference numbers represent schematic diagrams of the structure of the trajectory-controllable lateral drilling tool provided by the present disclosure.

Solution 1

Referring to FIGS. 1-5, the present disclosure provides a technical solution: a trajectory-controllable lateral drilling tool, which includes a lateral drilling section with high passing ability b and a power transmission section a. The lateral drilling section with high passing ability b can extend through a short to ultra-short radius well section d laterally from the main wellbore c to drill the extended section e. From front to back, the lateral drilling section with high passing ability b sequentially includes a drill bit 3, a steering short pup joint with high passing ability 1, and a transmission short pup joint array with high passing ability 2. The transmission short pup joint array with high passing ability 2 is composed of several transmission short pup joints 20 used to bear torque. The transmission short pup joints 20 can provide rotary drilling power to the drill bit 3 and have a pre-set deflection limit angle between adjacent transmission short pup joints 20, which is set to 0.5°-8°. Specifically, the power transmission section a includes a length of drill pipe for transmitting drilling power in the main wellbore. It should be noted that the drill pipe for transmitting rotary power in the main wellbore may be any type of drill pipe without special requirements or restrictions. The way of transmitting the drilling power may be driving the lateral drilling section with high passing ability b directly, or through transmitting high-pressure mud or electricity to drive the lateral drilling section with high passing ability b to rotate by a motor at the bottom of the well.

The transmission short pup joint array with high passing ability 2 has a through structure extending along its axial direction, forming a main flow channel for circulating drilling media, with the purpose of enabling the circulating of drilling media through the articulated structure. The advantage of the present disclosure is that the controllable transmission short pup joint array can be guided in a rotating state in the short radius wellbore. Under this condition, since the controllable transmission section array is generally rotating during directional drilling, the main component of frictional force is in the tangential direction of the universal joint 21 array, greatly reducing the axial friction force, which enables trajectory control in the ultra-short radius wellbore. The total length of the short to ultra-short radius well section d that the trajectory-controllable lateral drilling tool can drill using the drill rod does not exceed the total length of the drill bit 3 and the transmission short pup joint array with high passing ability 2.

Figure 3:
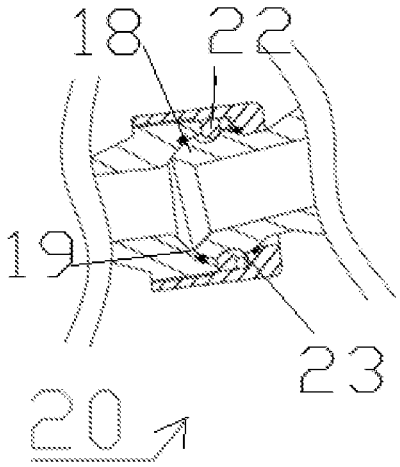
FIG. 3 is a partial schematic diagram of a transmission short pup joint in a trajectory-controllable lateral drilling tool.

In this embodiment, the universal joint 21 achieves torque transmission by setting the transmission pin 22 and the torque transfer 23 in the ball head 18 and ball socket 19. As shown in FIG. 3, the torque transfer groove 23 is set on the outer side of the ball head 18, the transmission pin 22 is fixedly set on the inner side of the ball socket 19, and the transmission pin is embedded in the torque transfer groove 23 to achieve torque transmission. The universal joint may also be any form of universal joint, and the structure used for torque transmission may also be any structure that can meet the requirements of torque transmission, such as transmission pin, ball, groove, teeth, etc. For example, the torque may also be transmitted between the ball head and the ball socket by interlocking with keyways or teeth slots.

In this embodiment, a relay communication device 4 is provided between the lateral drilling section with high passing ability b and the power transmission section a, the relay communication device 4 is electrically connected to the electrical line 7 inside the transmission short pup joint array with high passing ability 2, and the other end of the relay communication device 4 can remotely communicate with the wellhead end. Specifically, the relay communication device 4 realizes the guidance function and posture monitoring of the controllable trajectory by the ground device or personnel for the steering short pup joint with high passing ability 1, which better realizes the function of controllable trajectory.

In this embodiment, at least one universal joint 21 for variable angle rotation drilling power transmission is provided inside each transmission short pup joints 20, and the distance between adjacent universal joints 21 in the transmission short pup joint array with high passing ability 2 is less than 1 meter. Specifically, the universal joint 21 set inside the transmission short pup joint 20 is a constant velocity universal joint to achieve power transmission. The advantage of this is that the input end of the transmission short pup joint array with high passing ability 2 can maintain a stable rotation speed under the driving of the drilling tool above it. The power output of each transmission short pup joint 20 in the transmission short pup joint array with high passing ability 2 can be transmitted by a constant velocity universal joint 21, which ensures that the speed inconsistency between the input and output ends of the non-constant velocity universal joint in the transmission short pup joint array with high passing ability is prevented. The fluctuation of the output end speed of the high passage transmission short pup joint array 2 does not adversely affect the guidance precision of the high passage steering short pup joint 1.

The minimum distance between the deflection centers of adjacent transmission short pup joints 20 in the transmission short pup joint array with high passing ability 2 is less than 5 times the diameter of the drill bit 3. Generally, the distance between each universal joint 21 in the transmission short pup joint array with high passing ability 2 is within 0.4 meters. The purpose of limiting the distance between each universal joint in the transmission short pup joint array with high passing ability is to prevent excessive bending of the transmission short pup joints during transmission of WOB and torque, which could hinder the transmission and interfere with the control of the wellbore trajectory by the steering short pup joint with high passing ability. It should be noted that during drilling of the extension section of the short-ultra-short radius wellbore using the trajectory-controllable lateral drilling tool, a small section of the transmission short pup joint array with high passing ability is always in the short to ultra-short radius wellbore. Therefore, if the preset maximum deflection angle between adjacent transmission short pup joints is too large, the drilling tool will be bend excessively and affect the control of the wellbore trajectory by the high passage steering device; if the preset maximum deflection angle is too small, it will not be able to pass smoothly through the short to ultra-short radius wellbore. Generally, to further increase the stability of WOB and torque transmission and improve the efficiency of rotary drilling power transmission, the deflection angle between each transmission short pup joint 20 should be controlled within 3 degrees.

In this embodiment, a measuring device 12 is provided inside the steering short pup joint with high passing ability 1. The measuring device 12 includes a formation information measuring module, which contains at least a gamma sensor. The gamma sensor is fixedly installed inside any transmission short pup joint 20, and there is an electrical connection between the gamma sensor and the relay communication device 4, so that the measuring device 12 can transmit the measured formation information to the ground display device via the relay communication device 4.

In this embodiment, the steering short pup joint with high passing ability 1 includes an internally penetrated supporting structure 10, a hydraulic splitter 24, an electrical actuator 25, and one or several hydraulic piston subassembly 13. The one or several hydraulic piston subassembly 13 are fixedly connected to the supporting structure 10 of the steering short pup joint with high passing ability 1 in the circumferential direction.

The electrical actuator 25 can drive the hydraulic splitter 24 to allocate hydraulic fluid to the hydraulic piston subassembly 13, and distribute hydraulic fluid to each controllable hydraulic piston subassembly 13, thereby controlling the hydraulic pressure status of each hydraulic piston subassembly 13. It should be noted that the hydraulic force can come from a hydraulic power system, or from the drilling fluid in the main wellbore. In this embodiment, the pressure comes from the pressure difference between the main wellbore and the annular space. During the process of drilling fluid flowing from the main wellbore through the bit nozzle into the annular space, there is a large pressure drop, which provide the pressure needed to drive the driving piston.

In this embodiment, the steering short pup joint with high passing ability includes at least an internally penetrated supporting structure 10, 3-4 hydraulic piston subassembly 13, a hydraulic splitter 24, and an electrical actuator 25. The 3-4 hydraulic piston subassembly are uniformly arranged in the circumferential direction of the steering short pup joint with high passing ability, and fixedly connected to a cylindrical wall of the supporting structure 10. The hydraulic splitter 24 is set inside the supporting structure 10.

The function of the hydraulic splitter 24 in the present disclosure is to periodically allocate high-pressure drilling fluid to the hydraulic piston component device. Any form of hydraulic splitter is within the scope of protection of the present disclosure.

The electrical actuator 25 is only used to drive the hydraulic splitter 24 to perform actions. Any form of electrical actuator 25 is within the scope of protection of the present disclosure.

The following are three combinations of hydraulic splitters and electrical actuators:

The first combination of hydraulic splitter and electrical actuator: As shown in FIGS. 2-8, each group of hydraulic piston subassembly includes matched piston cylinder 13-1, piston 13-2, and a rib 13-3, or each group of hydraulic piston subassembly includes matched piston cylinder and a rib piston. The piston, rib, or rib piston is pushed by hydraulic fluid under distribution of the hydraulic splitter 24 and radially pushes against the borehole wall along the steering short pup joint with high passing ability, generating a combined force along the radial direction of the several piston components and causing the drill bit to deflect.

Figure 8:
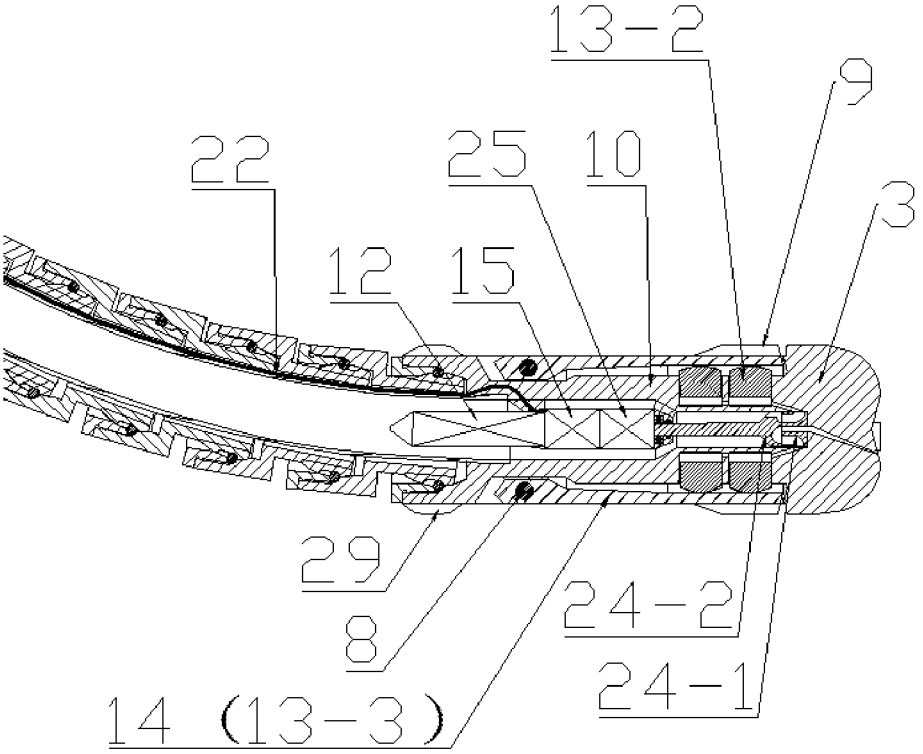
FIG. 8 is a partial schematic diagram of a lateral drilling tool based on an internal hinge structure.

The electrical actuator 25 is used to drive the hydraulic splitter 24 to distribute hydraulic fluid to each controllable hydraulic piston component, achieving the purpose of controlling the hydraulic pressure status of each piston cylinder. It should be noted that the source of the hydraulic force may be power fluid provided by the hydraulic power system, or drilling fluid in the main flow channel. The electric motor includes an electric motor stator 25-1 and an electric motor rotor 25-2, and the electric motor rotor 25-2 is coupled to the hydraulic splitter spool 24-2, which can drive the hydraulic splitter spool 24-2 to rotate. The hydraulic splitter 24 includes a valve housing 24-1 and a valve spool 24-2, and the valve housing contains at least one high-pressure inflow window and multiple supply windows. The high-pressure inflow window is connected to a through structure in the supporting structure 10. As shown in FIG. 8, as a more advantageous option, the valve spool is located at the end of the steering short pup joint with high passing ability 1 and on the side of the multiple hydraulic piston subassembly 13 away from the transmission short pup joint array with high passing ability 2. This can minimize the length of the supporting structure 10, which is beneficial for the trajectory-controllable lateral drilling tool to pass through higher curvature short to ultra-short radius well sections.

The several supply windows correspond one-to-one with the several hydraulic piston subassembly and are connected to the piston cylinder of each hydraulic piston component. The valve spool is provided with a supply flow channel, and the supply end includes at least an inlet end and a supply end 37. The inlet end may be connected to the through structure in the supporting structure, and the supply end may be connected to the flow path leading to each group of hydraulic piston subassembly. With the rotation of the valve spool, pressure communication between each high-pressure inflow window and the supply window leading to each hydraulic piston subassembly can be alternately connected and cut off, thus alternately supplying high-pressure drilling fluid to the hydraulic piston subassembly. During the guiding process, under the driving of the electric actuator, the hydraulic splitter valve shifts the supply end 37 on the valve spool in the opposite direction of the guidance direction, and provides high-pressure fluid to the hydraulic piston component in the corresponding sector located in the opposite direction of the guidance direction. The equivalent cross-sectional area of the supply flow channel on the valve spool and the flow path leading to the hydraulic piston component is greater than that of the bypass throttle structure 36, so the piston in the hydraulic piston component radially drives the rib to push against the wallbore. Conversely, the fluid in the piston cylinder of the hydraulic piston component located in the guidance direction is discharged from the bypass throttle structure 36. The sector in the guidance direction refers to a range not exceeding ±90 degrees from the guidance direction. The hydraulic piston subassembly of each group periodically push the radial rib along the steering short pup joint with high passing ability 1 under the action of the hydraulic splitter valve, and 3-4 hydraulic piston subassembly respectively push against the wallbore along the radial direction of the steering short pup joint to produce a resultant force that causes the drill bit 3 to deflect. It should be noted that the rib piston mentioned herein includes a piston structure and a plunger structure. If a piston or plunger structure is used to directly push against the borehole wall, there is no need for an independent rib. The pushing piston can be directly pushed by the hydraulic force in the piston cylinder, transmitting the thrust force. In this embodiment, the piston cylinder is connected to the hydraulic splitter 24 through a high-pressure flow channel 35.

Figure 9:
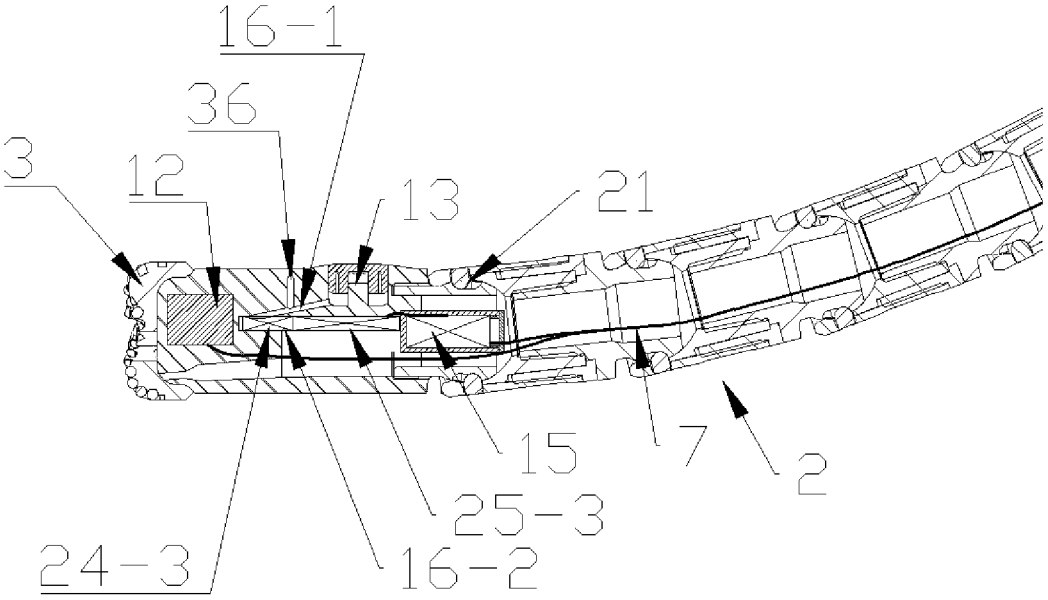
FIG. 9 is a schematic detailed design diagram of a steering short pup joint with high passing ability.

The second combination of hydraulic splitter and electrical actuator: As shown in FIG. 9, the electrical actuator 25 consists of several electromagnetic coils 25-3, each of which corresponds to a hydraulic piston component, and the hydraulic splitter 24 consists of multiple two-way two-position valves 24-3, each of which corresponds an electromagnetic coil. The electromagnetic coils and the two-way two-position valves form electromagnetic valves that periodically provide high-pressure drilling fluid to each hydraulic piston component.

The electromagnetic coils are electrically connected to the control module 15 and under the control of the control module, they drive the two-way two-position valve to open/close its first passage 16-1 and second passage 16-2. The first passage 16-1 is connected to the hydraulic piston component 13, and the second passage 16-2 is connected to the through structure. When the electromagnetic coil opens the valve channel, it can periodically connect the high-pressure drilling fluid in the through structure with the hydraulic piston component 13.

Specifically, the control module 15 opens the channel of the two-way two-position valve corresponding to the driving hydraulic cylinder 131, allowing the high-pressure fluid in the main flow channel to flow into the hydraulic piston component 13 through the two-way two-position valves, creating a larger pressure difference inside and outside the piston. This generates a guiding thrust on the wellbore wall by driving the piston. Correspondingly, the two-way two-position valve corresponding to the driving hydraulic cylinder 131 on the other side is closed, and the drilling fluid of the driving hydraulic cylinder 131 in the guidance direction is discharged through the throttle structure 36 without generating thrust. Therefore, the drilling fluid in the main flow channel is periodically distributed to each driving hydraulic cylinder 131 under the control of electromagnetic valve 143 in the control module 15 as the drill pipe rotates, and each driving hydraulic cylinder 131 generates a combined force along its radial direction to cause the drill bit 3 to deviate and change the trajectory of the wellbore.

The third combination of hydraulic splitter and electrical actuator: The electrical actuator 25 consists of several electric motors which can reciprocate and correspond to each hydraulic piston component. The hydraulic splitter 24 consists of two-way two-position valves 24-3 which can reciprocate and correspond to each electric motor. The electromagnetic valve formed by the solenoid and the two-way two-position valves provides high-pressure drilling fluid periodically to each hydraulic piston component.

The reciprocating electric motors convert the rotary motion of the electric motors into reciprocating motion that drives the operation of the two-way two-position valves through a screw or gear rack, and realizes control over the operation of the two-way two-position valve. Under the control of the control module, the two-way two-position valve, as a hydraulic diverter, executes actions to open/close the first passage 16-1 and the second passage 16-2. Its specific guiding method is consistent with the previous content and is not further elaborated here.

As the problem solved by the present disclosure is to achieve short to ultra-short radius directional drilling and continued drilling of extended wellbores, any equivalent substitution of the electrical actuator and hydraulic splitter by any means is within the scope of protection of the present disclosure. For example, the method of achieving guidance through solenoids and valves as described in US2008/068100 (PCT WO 2009/002996 A1) can be used as an equivalent substitute for the electrical actuator and hydraulic splitter in this patent.

The steering short pup joint with high passing ability 1 further includes a measuring device 12, which is arranged inside the supporting structure 10.

The trajectory-controllable lateral drilling tool further includes a control module 15, which contains at least one control chip. The sector in which the guidance direction lies is calculated and set by the hydraulic control chip according to the high edge angle of the drill bit tool face measured by the attitude measurement module. The rotating transformer 26, the electric motor stator 25-1, and the supporting structure 10 are fixedly connected, and the electric motor stator 25-1 is electrically connected to the motor driving circuit 15.

In this embodiment, there is also a power supply joint 5 located behind the transmission short pup joint array with high passing ability 2. The power supply joint 5 includes batteries and downhole generators. The power supply joint 5 is electrically connected to the steering short pup joint with high passing ability 1 through the electrical line 7 to provide power to the electric actuator 25 in the steering short pup joint with high passing ability 1.

This embodiment further includes a straightening device 28 whose one end is coaxially connected to the steering short pup joint with high passing ability, and the other end is connected to the transmission short pup joint array with high passing ability. The straightening device can elastically connect the steering short pup joint with high passing ability 1 with the transmission short pup joint array with high passing ability 2 behind it, so as to maintain coaxial characteristics between the two short sections.

According to FIG. 8, in this embodiment, there are transmission rib wings 14 on the outside of the supporting structure 10, which may be spoon-shaped structures. The transmission rib wings 14 are hinge joint to the supporting structure 10 through inner hinge structures 8. The transmission rib wings, also known as ribs 13-3, push against the piston rib wings and drive the rib wings to swing towards the wellbore around the inner hinge structure 8, transmitting thrust to the wellbore through the transmission rib wings. The shell of the supporting structure 10 is provided with wellbore, which is the piston cylinder 13-1. In any embodiment, a hydraulic piston component 13 may be provided on the supporting structure 10, or a piston cylinder 13-1 can be formed by drilling holes in the shell structure of the supporting structure 10 itself. The piston 13-2 is provided in the piston cylinder and moves in the active gap between the transmission rib wings 14 and the supporting structure 10.

There is a measuring device 12 in the steering short pup joint with high passing ability that can measure the drill bit's orientation, including acceleration sensors and/or magnetic sensors and/or gyroscopes. As a better option, the measuring device includes at least three-axis acceleration sensors and three-axis magnetic sensors. It can measure the tilt angle, azimuth angle, and tool face angle of the steering short pup joint with high passing ability.

Figure 10:
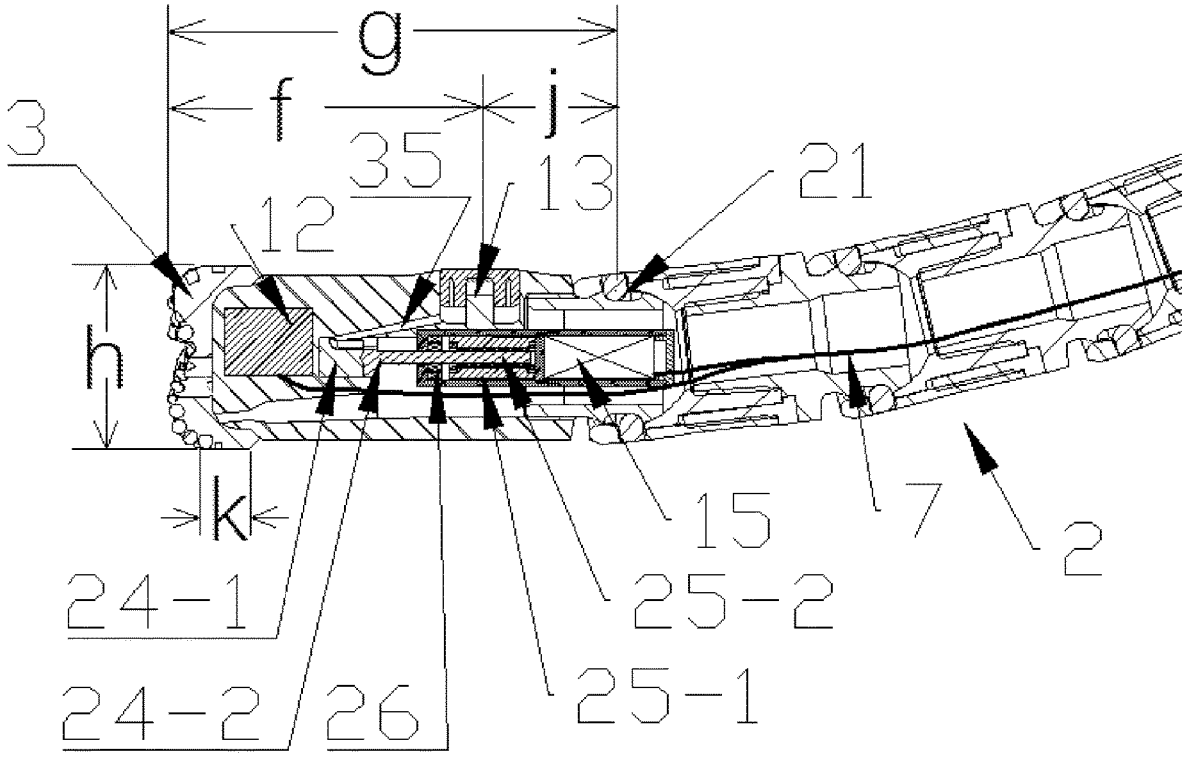
FIG. 10 is a schematic design diagram of a steering short pup joint.

To improve the guidance effect and flexibility, as shown in FIG. 10, the distance f between the hydraulic piston component and the drill bit front end surface is greater than the distance j between the hydraulic piston component and the frontmost hinge structure; the distance g between the drill bit front end surface and the frontmost hinge structure does not exceed four times the drill bit diameter h; the length k of the drill bit gauge section is not less than 10% of the drill bit diameter, which is used to limit the alignment of the drill bit axis with the wellbore axis, so that there is a reasonable gap between the supporting body 10 and the wellbore for the necessary movement space for the expansion and thrust of the hydraulic piston component 13 against the borehole wall. It should be noted that the frontmost hinge structure is the frontmost deflection point in the lateral drilling section with high passing ability, which can be the deflection point between the steering short pup joint with high passing ability 1 and the transmission short pup joint array with high passing ability 2, which is the frontmost universal joint 21.

Solution 2

Figure 4:
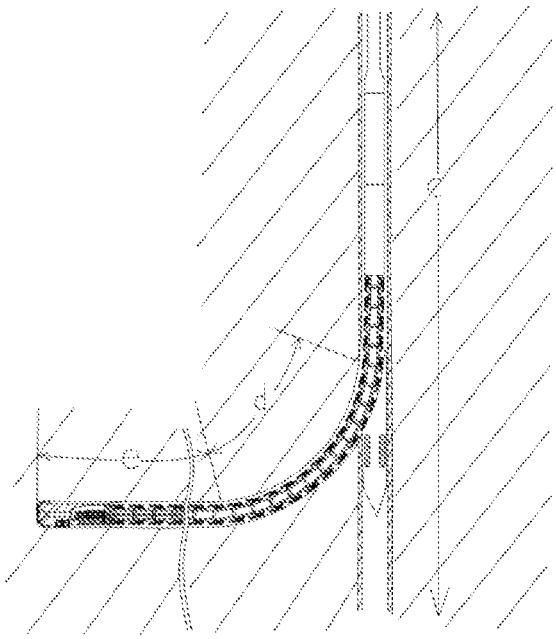
FIG. 4 is a schematic diagram of the drilling operation of a trajectory-controllable lateral drilling tool in an extended well section.
Figure 5:
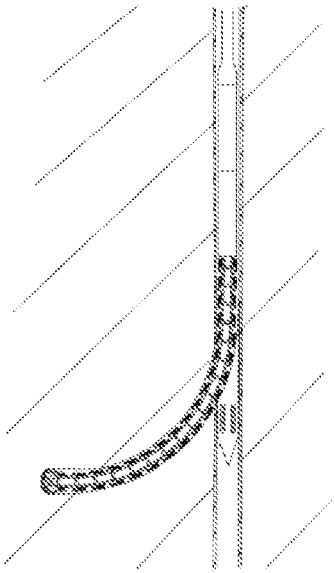
FIG. 5 is a schematic diagram of the drilling operation of a trajectory-controllable lateral drilling tool in a deviated well section.

The present disclosure provides a trajectory-controllable lateral drilling method, including the following steps as shown in FIGS. 4 and 5:

Step 1: The short-ultra short radius directional drilling tool includes a flexible drill rod and a high-directional drilling bit. Using a conventional drill pipe to drive the high-directional drilling bit through a specific length of flexible drill rod, the short-ultra short radius section d is laterally drilled with the help of the directional force provided by the directional tool and the WOB. The length of the flexible drill rod and the high-directional drilling bit is not less than that of the short-ultra short radius section.

Step 2: Retrieve the flexible drill rod and the high-directional drilling bit, then insert the trajectory-controllable lateral drilling tool to traverse the short-ultra short radius section d and complete the drilling of the extended section. The directional tool can support the trajectory-controllable lateral drilling tool within the main wellbore c.

Solution 3

In another embodiment of the present disclosure, when the main wellbore is inclined and its azimuthal angle is different from that of the branch wellbore, a variable azimuth trajectory-controllable lateral drilling method is provided, including the following steps:

Step 1: Taking this embodiment as an example, if the inclination angle of the main wellbore at the window opening level is θ and its azimuthal angle is facing north, the directional tool should face north after being placed at the designated opening position, and then anchored. The window milling bit is used to mill the window towards the north of the main wellbore.

Figure 6:
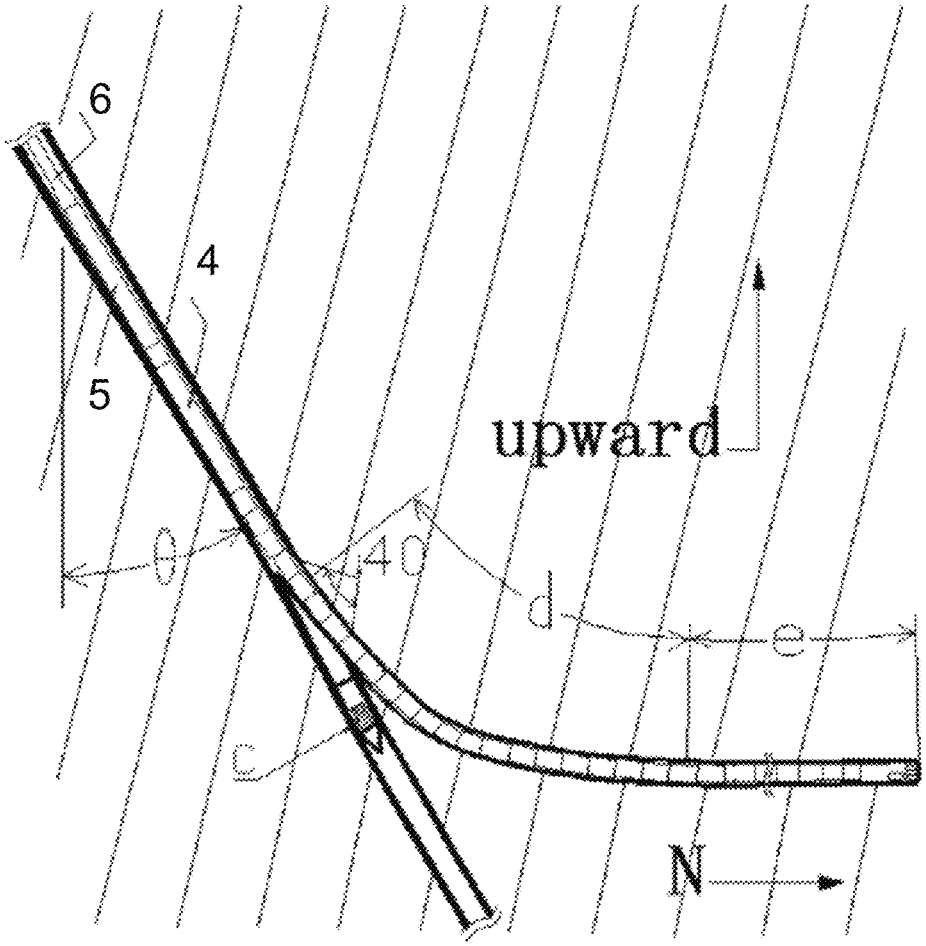
FIG. 6 is a schematic diagram of the vertical projection of a trajectory-controllable lateral drilling method.

Step 2: As shown in FIG. 6, in this embodiment, the short-ultra short radius directional drilling tool includes the aforementioned flexible drill rod and high-directional drilling bit. Using a conventional drill pipe to drive the high-directional drilling bit through a specific length of the flexible drill rod, the short-ultra short radius section is laterally drilled towards the north under the influence of the directional force and/or WOB provided by the directional tool, until it is close to a horizontal state. The azimuth direction of the short-ultra short radius section is consistent with that of the main wellbore, facing towards the north. It should be noted that in general, the short-ultra short radius section will reach an almost horizontal position near the target layer from the starting point of the window opening.

Figure 7:
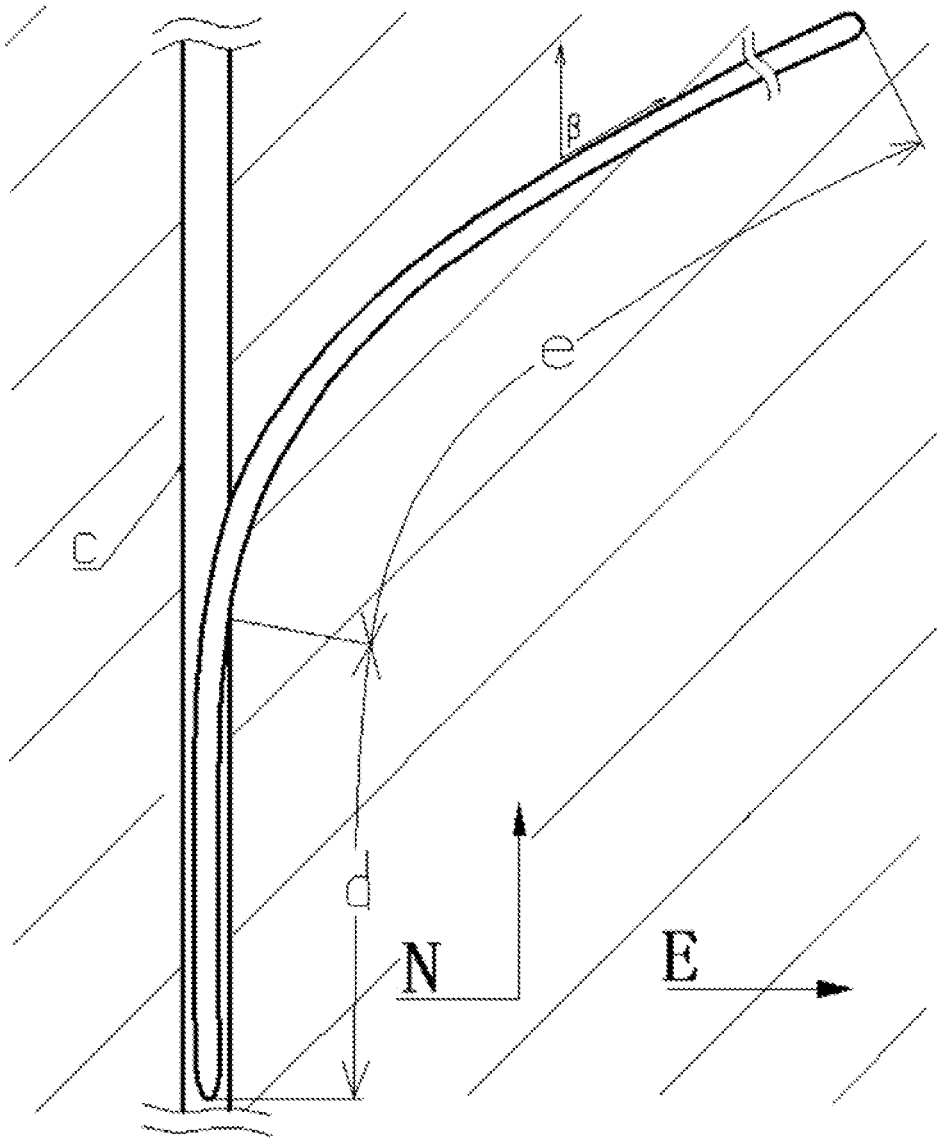
FIG. 7 is a schematic diagram of the horizontal projection of a trajectory-controllable lateral drilling method.

Step 3: As shown in FIG. 7, the flexible drill rod and high-directional drilling bit are pulled out from the wellbore, then inserted into the trajectory-controllable lateral drilling tool and passed through the short-ultra short radius section to complete the drilling of the extended wellbore. The directional tool can support the trajectory-controllable lateral drilling tool within the main wellbore. During the drilling of the extended wellbore, the azimuth direction of the extended wellbore is gradually changed until reaching the design azimuth angle β.

The short-ultra short radius directional drilling section refers to the wellbore section with a short-ultra short radius, while the short-ultra short radius directional drilling section refers to the drilling section with a short-ultra short radius.

It should be noted that in some special cases, when the main wellbore undergoes simultaneous changes in inclination and azimuth angles and lateral drilling is required at the window opening, the coordinate system of the main wellbore is established based on the window opening point, and the direction with the largest change rate in the azimuth angle is selected for lateral drilling. Subsequently, short-to-ultra radius drilling is completed, followed by drilling of the extended wellbore. During the drilling of the extended wellbore, the direction of the extended wellbore is gradually adjusted towards the designated direction.

It should be noted that before using the short-ultra short radius directional drilling tool for lateral drilling in the short-ultra short radius section, it is often necessary to first insert the directional tool, which is generally fixedly connected to an anchoring tool. The anchoring tool is secured by engaging with the inner wall of the casing in the main wellbore or by fixing it to the wall of the main wellbore, and the guiding tool face is fixed in a specific direction. A milling drill bit is inserted to create a window for lateral drilling. This process is well-known in the art and therefore will not be described here in detail. In addition, for ease of understanding, the present disclosure divides the window milling, short-ultra short radius drilling, and extended wellbore drilling into three separate drilling operations. However, any two or all three of these operations can be combined into one drilling operation and shall still fall within the scope of protection of the present disclosure.

It should be noted that the term "rotation" in the present disclosure refers to the rotation along its own axis, while "deflection" refers to the action of pushing the device through the guidance device to cause its axis to bend or deviate from its original position.

Furthermore, it should be noted that the steering short pup joint with high passing ability mentioned in the present disclosure is not limited to the specific structure described in the embodiments. Any device that can perform guidance functions and meets the size and function requirements described in the present disclosure can be used as an equivalent substitution for the specific structure of the steering short pup joint with high passing ability described in the embodiments.

Solution 4

FIGS. 11-16 and their corresponding reference numbers provide schematic diagrams of the structure and application status of the short radius drilling tool provided by the present disclosure.

Currently, downhole tools that provide drilling capabilities while rotating include rotary directional drilling technology. The conventional rotary directional drilling tool can produce a curvature of approximately 6°/30 m. The shortest radius directional guidance system used by Schlumberger can only reach 15°/30 m, and at most 18°/30 m in small wellbores. However, in the field of short-ultra short radius drilling, the curvature radius required for directional drilling typically ranges from 10 m to 60 m, and within 10 m in the field of ultra short-radius drilling. Due to the inherent inability of current rotary directional drilling systems to be bent, it is almost impossible to meet the actual needs of short radius drilling. Moreover, it is impossible to achieve short-ultra short radius directional drilling with a turning radius of less than 60 m under rotary drilling conditions. Other related products in the existing technology also suffer from the inability to control the trajectory of the wellbore under rotary drilling conditions, leading to serious drag and drilling issues.

To address the above issues, as shown in FIGS. 11, 12, 13, and 15, the present disclosure provides a short radius drilling tool that can achieve short-ultra short radius wellbore drilling of 300 and/or complete drilling of the extended wellbore 300 through the short-ultra short radius wellbore 300. The short radius drilling tool includes a steering short pup joint 100, a driving drill pipe 200, and a driving control short pup joint.

The steering short pup joint 100 includes a steering pup joint 120 and a drill bit 110. The steering pup joint 120 includes a supporting body 121. The supporting body 121 is tubular and its length is less than 1.5 meters, suitable for the curvature of the wellbore 300 in ultra short-radius branching wells. The supporting body 121 is equipped with a steering mechanism 130 and an electrically driven actuator 140 for executing the guidance function. The drill bit 110 is connected to the lower end of the supporting body 121. The steering mechanism 130 can drive the drill bit 110 to deflect in an expected direction, so as to change the trajectory of the wellbore 300 under rotary drilling conditions and achieve a short curvature.

The driving drill pipe 200 includes multiple supporting short pup joints 210 connected from top to bottom. For better adaptation to the curvature of the wellbore 300 in ultra-short radius branching wells, the length of each supporting short pup joint 210 is preferably less than 1.2 meters. The bottommost supporting short pup joint 210 is connected to the supporting body 121, and the adjacent two supporting short pup joints 210 and the supporting short pup joint 210 and the supporting body 121 are all articulated by a WOB and torque deflection transfer mechanism 220. In other words, the driving drill pipe 200 has a knuckle joint structure, and the WOB and torque deflection transfer mechanism 220 can transmit the power for rotary drilling and advance the driving drill pipe 200.

The driving control short pup joint can be articulated separately with the steering pup joint 120 and the bottommost supporting short pup joint 210 through the WOB and torque deflection transfer mechanism 220. Alternatively, the driving control short pup joint can be connected to any adjacent two supporting short pup joints 210 through the WOB and torque deflection transfer mechanism 220. It can also be connected to the upper end of the driving drill pipe 200 through the WOB and torque deflection transfer mechanism 220. The electrically driven actuator driving control circuit 230 is set behind the supporting body 121 to accommodate electrically driven actuator driving control circuits with higher space requirements and heat dissipation requirements. This layout not only maximizes the reduction in the length of the supporting body 121 to improve the passage of the short radius drilling tool, but also provides better shock absorption for the electrically driven actuator driving control circuit. Ideally, the length of the driving control short pup joint is less than 1.5 meters. The electrically driven actuator driving control circuit 230 is installed on the driving control short pup joint, and is electrically connected to the electrically driven actuator 140 through a crossover cable 240 that can span the WOB and torque deflection transfer mechanism 220, allowing the electrically driven actuator 140 in the supporting body 121 to be electrically connected to the electrically driven actuator driving control circuit 230 in the supporting short pup joint 210.

Figure 16:
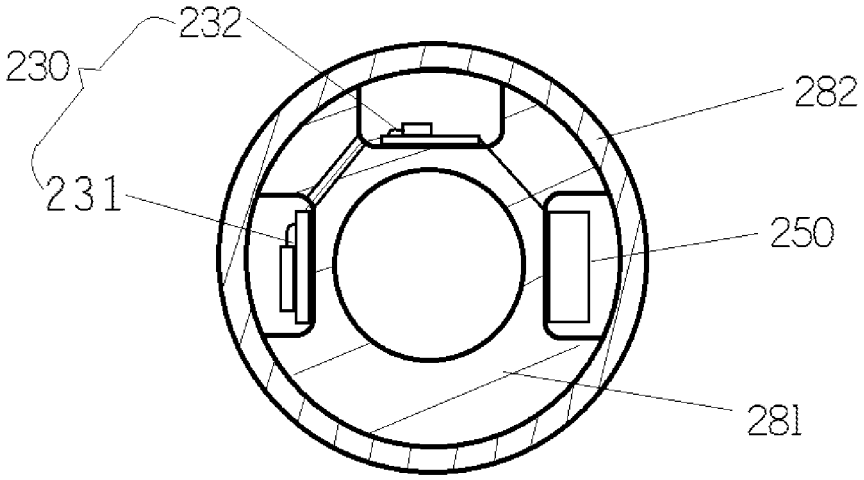
FIG. 16 is a schematic diagram of the cross-sectional structure of a driving control short pup joint.

It should be noted that as shown in FIG. 16, a pressurized structure is set up inside the driving control short pup joint, generally formed by a pressurized body 281 and a pressurized sleeve 282 to create a sealed compartment, where the electrically driven actuator driving control circuit 230 is located inside the sealed compartment.

The short radius drilling tool of the present disclosure uses the steering mechanism 130 to drive the drill bit 110 to deflect in an expected direction under rotational conditions, changing the trajectory of the wellbore 300 to achieve a shorter inclination angle. By setting the electrically driven actuator driving control circuit 230 with a large number of power devices requiring heat dissipation space inside the driving control short pup joint behind the supporting body 121, only the steering mechanism 130 and electrically driven actuator 140 are retained inside the steering pup joint 120, effectively shortening the length of the steering pup joint 120, making it easier to achieve directional functionality in high curvature wellbores 300.

Figure 11:
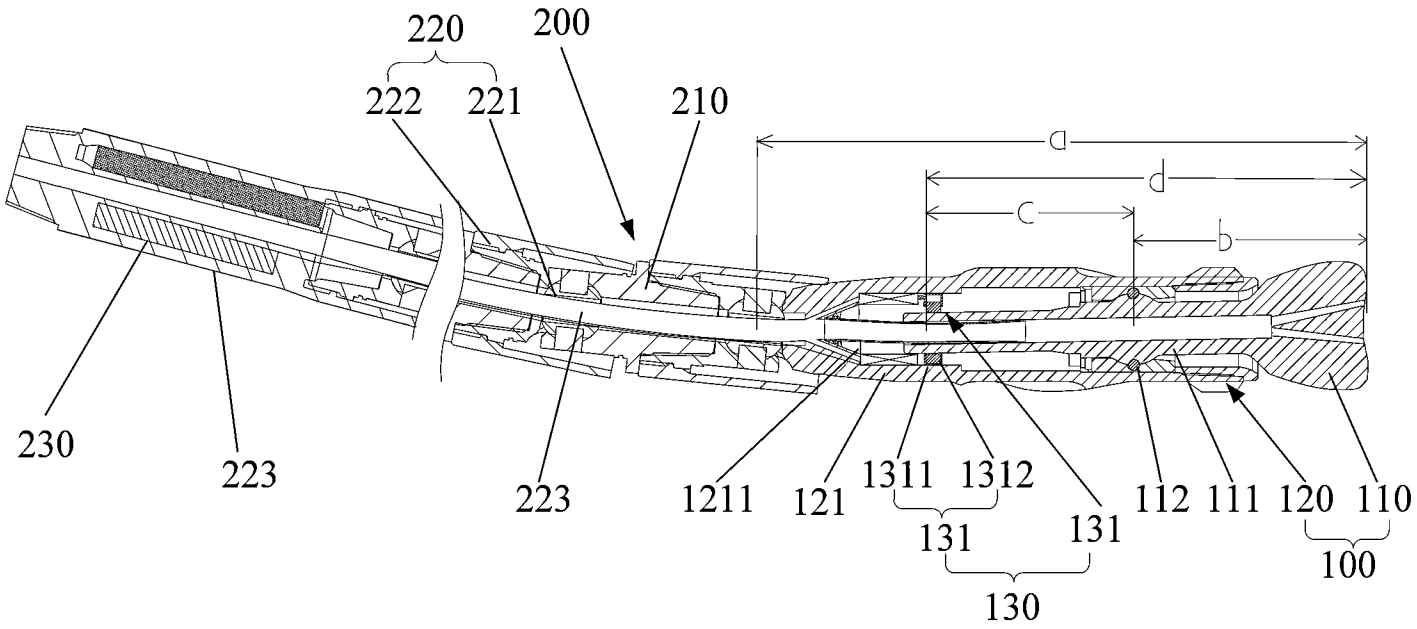
FIG. 11 is a schematic diagram of the structure of a short radius drilling tool according to a first embodiment of the present disclosure.
Figure 12:
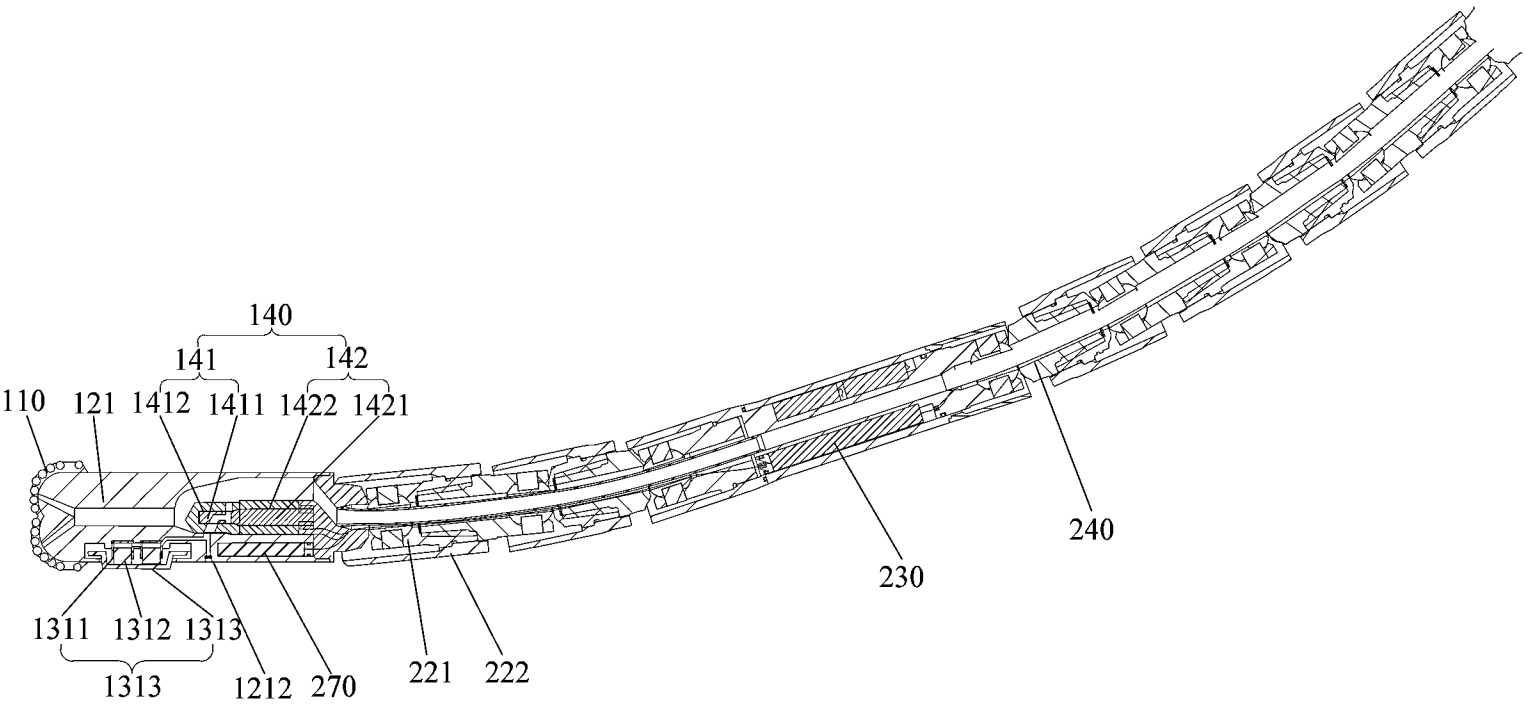
FIG. 12 is a schematic diagram of the structure of a short radius drilling tool according to a second embodiment of the present disclosure.
Figure 13:
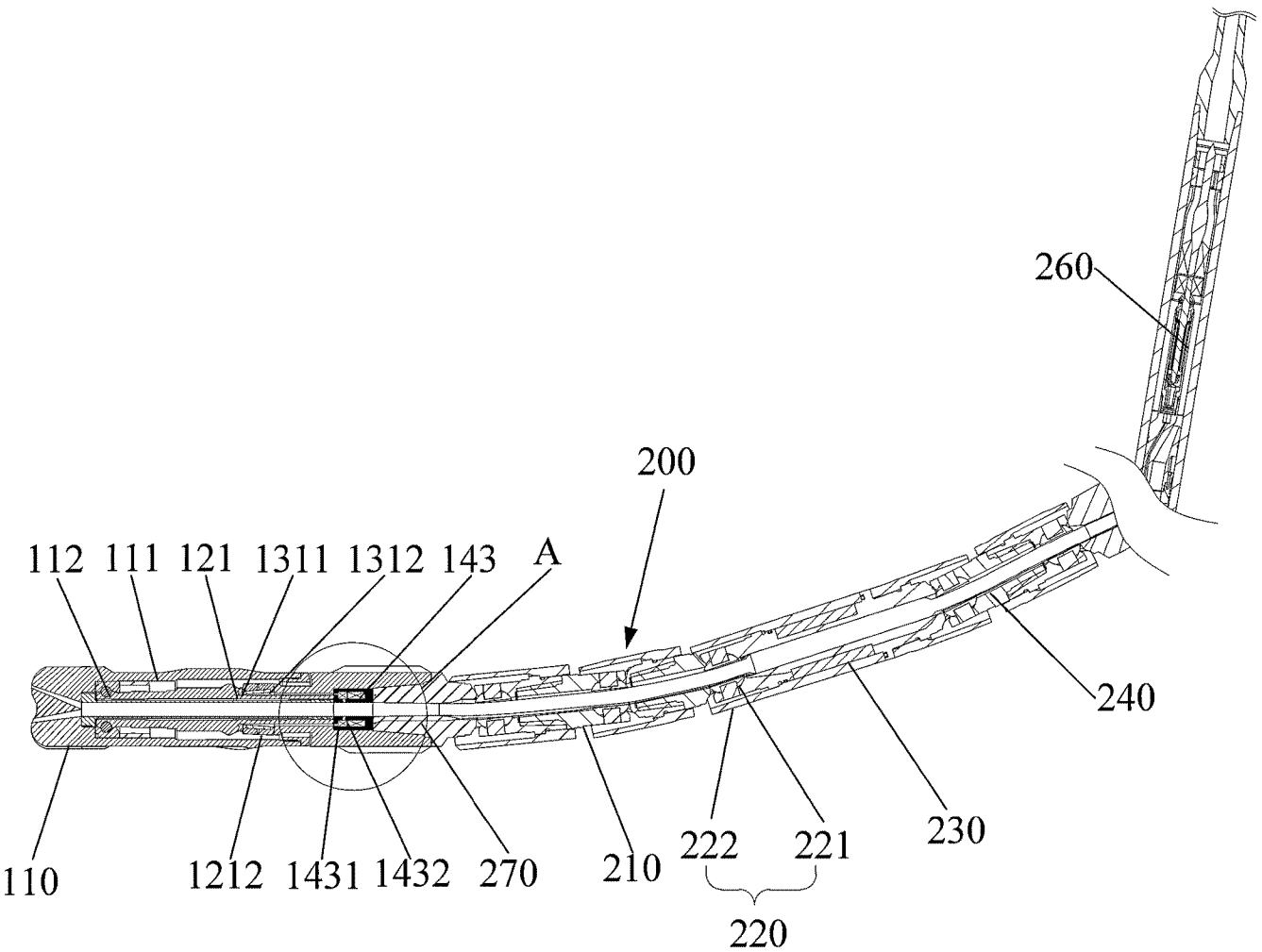
FIG. 13 is a schematic diagram of the structure of a short radius drilling tool according to a third embodiment of the present disclosure.

Furthermore, as shown in FIGS. 11, 12, and 13, the steering mechanism 130 includes at least three sets of driving hydraulic cylinders 131 arranged radially along the supporting body 121 at equal intervals. Preferably, the driving hydraulic cylinders 131 are evenly spaced apart. Each driving hydraulic cylinder 131 includes a piston cylinder 1311 connected to the tubular wall of the supporting body 121 and a driving piston 1312 set within the piston cylinder 1311. The driving piston 1312 can move radially along the supporting body 121 and can abut the wellbore. By driving the piston 1312 to extend or retract, the drill bit 110 can be deflected in an expected direction. Specifically, by adjusting the extension and retraction of each driving piston 1312, the thrust force that each driving piston 1312 exerts on the wellbore can be adjusted. The wellbore will exert a reaction force on the supporting body 121 through the driving piston 1312, causing the supporting body 121 to drive the drill bit 110 to deflect a certain angle relative to the wellbore, thereby changing the trajectory of the wellbore 300.

It should be noted that the purpose and significance of using the driving hydraulic cylinder 131 is that the hydraulic force can apply a flexible and relatively constant pressure to push against the borehole wall, allowing it to operate steadily within a certain range of wellbore curvature without getting stuck. In addition, due to the limited space for designing downhole instruments, the shape of the driving piston 1312 and piston cylinder 1311 may not be a standard cylindrical shape. The driving piston 1312 can be a piston structure, plunger structure, or any other equivalent substitute. Various sealing methods such as metal sealing, rubber sealing, or O-ring sealing can be used between the driving piston 1312 and the piston cylinder 1311 to facilitate the extension and retraction function of the driving piston 1312. The cross-sectional shapes of the piston cylinder 1311 and the driving piston 1312 are compatible and can be circular, square, or slotted, etc.

Furthermore, the driving piston 1312 is connected with a rib 1313, which allows the driving piston 1312 to be in contact with the wellbore through the rib 1313.

Moreover, the short radius drilling tool further includes a strapdown attitude measurement module 270 and a guidance control circuit 250. The strapdown attitude measurement module 270 is fixedly installed in the short radius drilling tool, typically on the supporting body 121, for measuring the gravity tool face angle and/or magnetic tool face angle of the short radius drilling tool downhole. The guidance control circuit 250 is electrically connected to the strapdown attitude measurement module 270 and the electrically driven actuator driving control circuit 230, and controls the electric driver actuator 140 to perform instructed movements to further drive the steering mechanism 130 to deflect the drill bit 110 in the desired direction based on the measured gravity tool face angle and/or magnetic tool face angle.

Furthermore, the steering mechanism 130 is fixedly installed on the supporting body 121, which is respectively connected to the drill bit 110 and the drive drill pipe 200 to transmit the WOB and torque from the drive drill pipe 200 to the drill bit 110 through the supporting body 121 of the steering pup joint 120. The steering mechanism 130 rotates along with the drive drill pipe 200 to better clean the wellbore 300, prevent drag pressure, and enable the short radius drilling tool to achieve guidance function under full rotation conditions.

Moreover, as shown in FIG. 16, the electrically driven actuator driving control circuit 230 includes a ring-shaped switch tube carrying circuit board 231 and a ring-shaped switch tube driver carrying circuit board 232. Both the switch tube carrying circuit board 231 and the switch tube driver carrying circuit board 232 are set inside the cylindrical carrying short section 210, with switch tubes on the switch tube carrying circuit board 231 and switch tube drivers on the switch tube driver carrying circuit board 232, which are electrically connected. Such a structure can compress the axial length of the electrically driven actuator driving control circuit 230 to the shortest, thus improving the passage capacity of the carrying short section 210.

It should be noted that when the electric driver actuator 140 is an electric motor, the switch tube is used to drive the stator coils of the electric motor to produce sine waves or square waves to rotate the electric motor. When the electric driver actuator is an electromagnet, the switch tube is used to drive the current conduction state of the electromagnet coil.

Furthermore, as shown in FIG. 16, the short radius drilling tool also includes a guidance control circuit 250, which is electrically connected to the electrically driven actuator driving control circuit 230. The guidance control circuit 250 is used to drive the electric driver actuator 140 through the electrically driven actuator driving control circuit 230 so that the piston cylinder 1311 in the sector facing away from the guidance direction contacts the high-pressure fluid in the internal passage of the supporting body 121 of the steering pup joint 120.

Furthermore, as shown in FIG. 13, the short radius drilling device also includes a power short pup joint 260, which is connected in series at any position of the drive drill pipe 200, or alternatively, connected to the upper end of the drive drill pipe 200. The power short pup joint 260 is used to supply power to the short radius drilling tool.

Furthermore, as shown in FIGS. 12 and 13, the strapdown attitude measurement module 270 is fixedly connected to the supporting body 121. The strapdown attitude measurement module 270 includes at least one accelerometer, which measures the inclination angle of the wellbore. The angle between the mounting direction of the accelerometer and the axis direction of the supporting body 121 is between 0-60°.

Furthermore, the strapdown attitude measurement module 270 also includes at least one magnetometer, which is used to measure the magnetic azimuth angle near the drill bit 110. The supporting body 121 is made of non-magnetic material to avoid interference with the magnetometer.

It should be noted that the drill bit 110 is made of non-magnetic material, which can better avoid interference with the magnetometer.

Furthermore, at least one of the switch tube driver carrying circuit board 232, guidance control circuit 250, and strapdown attitude measurement module 270 is manufactured using thick film circuit technology to minimize space consumption and to minimize the axial length of each circuit in the supporting short pup joint 210. This aims to maximize the passage capability of the short radius drilling tool.

Furthermore, the WOB and torque deflection transfer mechanism 220 includes a transfer universal joint 221 and a fixed sleeve 222 that is externally set on the transfer universal joint 221. There is a gap between the fixed sleeve 222 and the transfer universal joint 221 to form a deflection space. The transfer universal joint 221 can deflect 0°-15° relative to the axis of the fixed sleeve 222 within the deflection space. The deflection angle of the transfer universal joint 221 is limited by the fixed sleeve 222 to prevent excessive bending during the transfer of WOB and torque and to facilitate smooth transmission.

Furthermore, the transfer universal joint 221 is provided with a through structure, and a flow tube 223 for circulating drilling fluid is provided within the through structure.

It should be noted that the transfer universal joint 221 can be a cross-axis universal joint that can transmit axial force, or a combination of any universal joint and ball joint.

It should also be noted that the connection between the driving control short pup joint and the steering pup joint adopts the hinge connection of the WOB and torque deflection transfer mechanism. Additionally, the connection between the driving control short pup joint and the supporting short pup joint also adopts the hinge connection of the WOB and torque deflection transfer mechanism. Furthermore, the WOB and torque deflection transfer mechanism includes at least one transfer universal joint that can transmit axial force, such as a cross-axis universal joint or a combination of any universal joint and ball joint.

Implementation of Solution 4—Option 1

As shown in FIG. 11, the upper end of the drill bit 110 is coaxially connected to a transmission lever 111. Specifically, the transmission lever 111 is tubular in shape and passes through the inside of the supporting body 121. The transmission lever 111 is preferably integrated with the drill bit 110. Alternatively, the transmission lever 111 is welding connected to the upper end of the drill bit 110. The transmission lever 111 is connected to the lower part of the supporting body 121 through a controllable universal joint 112. There is an active gap between the transmission lever 111 and the supporting body 121, which is where the steering mechanism 130 is located. The steering mechanism 130 is positioned above the controllable universal joint 112. The driving piston 1312 can be brought into contact with the wellbore wall through the transmission lever 111, and the extension and contraction of the driving piston 1312 can drive the transmission lever 111 to rotate around the center of the controllable universal joint 112 to guide the drill bit 110 to deflect in an expected direction.

It should be noted that the length of the upper force arm of the transmission lever 111 is at least 30% of the distance between the controllable universal joint 112 and the WOB and torque deflection transfer mechanism 220 located above it, in order to fully utilize the space of the supporting body 121 to extend the upper force arm and provide the drill bit 110 with as much directional force as possible.

The length of the lower force arm of the transmission lever 111 is less than 50% of the distance between the controllable universal joint 112 and the WOB and torque deflection transfer mechanism 220 located above it, in order to minimize the interference caused by drill bit 110 torque or vibration to the transmission lever 111 and maximize the stability of the guidance process.

The length of the upper force arm c of the transmission lever 111 is the distance between the controllable universal joint 112 and the point where the steering mechanism 130 exerts force on the transmission lever. The length of the lower force arm b is the distance between the lower end face of the drill bit 110 and the controllable universal joint 112.

Furthermore, the distance d between the steering mechanism 130 and the upper end of the drill bit 110 is at least 50% of the distance a between the upper end of the drill bit 110 and its adjacent controllable universal joint 112, so that the supporting body 121 can exert sufficient lateral force on the drill bit 110.

Implementation of Solution 4—Option 2

As shown in FIG. 12, the driving hydraulic cylinder 131 is located below the WOB and torque deflection transfer mechanism 220 that is connected to the supporting body 121, and the distance from the position of the driving hydraulic cylinder 131 to the drill bit 110 is less than the distance between the driving hydraulic cylinder 131 and the WOB and torque deflection transfer mechanism 220 that is connected to the supporting body 121. This design allows the point of action of the thrust force to be closer to the drill bit 110 and farther from the turning point, thereby driving the drill bit 110 to deflect in the guidance direction.

The electrically driven actuator 140 includes a rotary valve 141 and a driving motor 142. A through-flow channel 1211 is provided on the supporting body 121. The rotary valve 141 can periodically connect the through-flow channel 1211 with the driving hydraulic cylinder 131, allowing the driving piston 1312 to periodically abut against the borehole wall as the drilling pipe rotates, thereby obtaining a reactive force from the wellbore against the supporting body 121 of the steering pup joint 120 and driving the drill bit 110 to deflect in the preset guidance direction. The driving motor 142 is electrically connected to the electrically driven actuator driving control circuit 230, and the motor is controlled by the electrically driven actuator driving control circuit 230.

Furthermore, the rotary valve 141 includes a rotary valve rotor 1411 and a rotary valve stator 1412, with the rotary valve stator 1412 fixedly connected to the supporting body 121. The rotary valve stator 1412 is provided with multiple valve positions that correspond to each of the driving hydraulic cylinders 131. The driving motor 142 includes a driving motor rotor 1421 and a driving motor stator 1422, with the driving motor stator 1422 fixedly connected to the supporting body 121. The rotary valve rotor 1411 and the driving motor rotor 1421 are mutually coupled, and the driving motor rotor 1421 can drive the rotary valve rotor 1411 to rotate relative to the rotary valve stator 1412, supplying high-pressure drilling fluid periodically to each driving hydraulic cylinder 131 through their respective valve positions on the rotary valve stator 1412, causing the driving piston 1312 to periodically generate thrust.

It should be noted that the preset guidance direction can be set before the tool is deployed or preset during drilling by transmitting signals through changes in mud pressure or flow rate. Drilling fluid from the drill pipe enters the drill bit 110 and then the annular space through the through-flow channel 1211 in the supporting body 121. Nozzles or other throttling devices 1212 that can generate a pressure drop are installed in the drill bit 110 or the flow path between the drill bit 110 and the rotary valve 141. When the drilling fluid flows through the nozzles or throttling structures, a pressure drop is generated, which drives the hydraulic cylinder 131. The specific process and principle of generating the pressure difference are common knowledge in the field and will not be described here. The periodic connection means that the connection between the through-flow channel and the driving hydraulic cylinder changes periodically with the rotation of the short radius drilling tool to ensure that the driving hydraulic cylinder in a specific sector receives hydraulic force to drive the transmission lever to guide the drill bit in the preset guidance direction. The mutual coupling means that the connection between the driving motor rotor and the rotary valve rotor can ensure synchronous rotation, including but not limited to plug-in connection.

Implementation of Solution 4—Option 3

Figure 14:
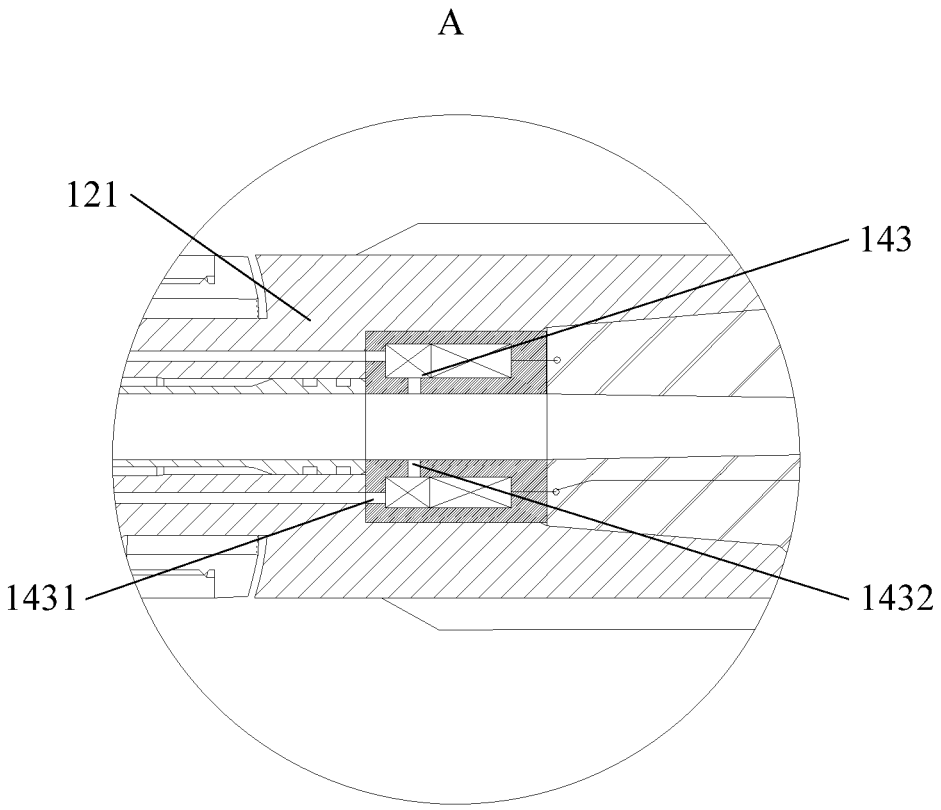
FIG. 14 is a schematic diagram of the enlarged structure of Part A in FIG. 13.
Figure 15:
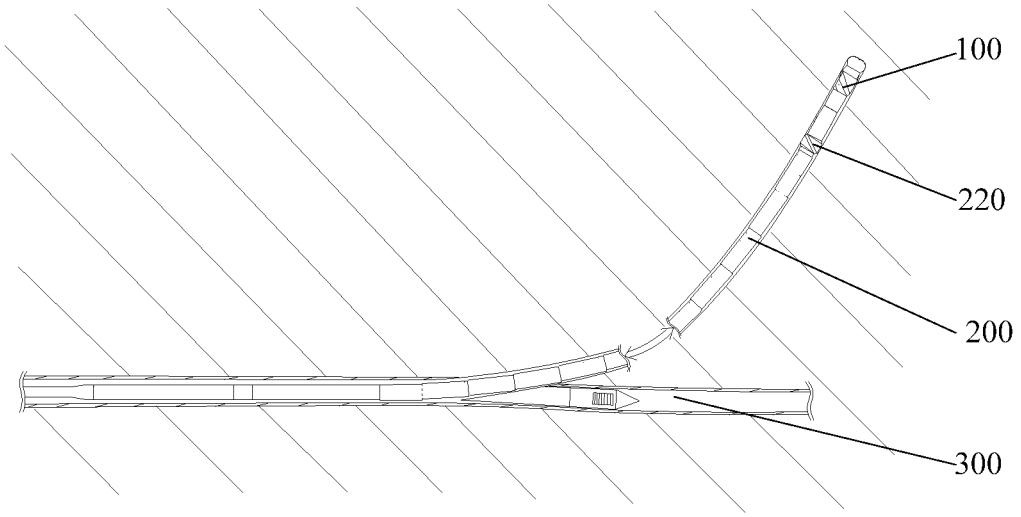
FIG. 15 is a schematic diagram of a short radius drilling tool of the present disclosure in an operating state.

As shown in FIGS. 13 and 14, the driving hydraulic cylinder 131 is located below the WOB and torque deflection transfer mechanism 220, which is connected to the supporting body 121. The distance between the setting position of the driving hydraulic cylinder 131 and the drill bit 110 is shorter than the distance between the driving hydraulic cylinder 131 and the WOB and torque deflection transfer mechanism 220 connected to the supporting body 121, so that the point of action of the thrust force is closer to the drill bit 110 and farther from the turning point, thereby driving the drill bit 110 to deflect in the preset guidance direction.

The electrically driven actuator 140 includes a rotary valve 141 and a driving motor 142, and a through-flow channel 1211 is provided on the supporting body 121. The rotary valve 141 can be periodically connected to the driving hydraulic cylinder 131 through the through-flow channel 1211, and the driving motor 142 is electrically connected to the electrically driven actuator driving control circuit 230.

Furthermore, the electrically driven actuator 140 includes multiple electromagnetic valves 143, each of which corresponds to a respective driving hydraulic cylinder 131. Each electromagnetic valve 143 is electrically connected to the electrically driven actuator driving control circuit 230 and is a two-way two-position valve 143. The electromagnetic valve 143 has a first passage 1431 connected to the driving hydraulic cylinder 131 and a second passage 1432 connected to the through-flow channel 1211. The electromagnetic valve 143 can periodically connect the passage and the driving hydraulic cylinder 131. Specifically, the electrically driven actuator driving control circuit 230 opens the passage of the two-way two-position valve corresponding to the driving hydraulic cylinder 131 in the opposite direction of the guidance direction, allowing high-pressure fluid in the waterway to flow into the piston cylinder 1311 through the electromagnetic valve 143, creating a large pressure difference inside and outside the driving hydraulic cylinder 131. The driving piston 1312 generates guiding thrust by pushing against the borehole wall. Correspondingly, the two-way two-position valve corresponding to the driving hydraulic cylinder 131 in the guidance direction is in a closed state, allowing the drilling fluid to flow out of the piston through the throttling device 1212 without generating thrust. Therefore, the drilling fluid in the waterway is periodically distributed to each driving hydraulic cylinder 131 by the electromagnetic valve 143 under the control of the electrically driven actuator 140 control circuit, and each driving hydraulic cylinder 131 generates a radial thrust against the borehole wall, causing the drill bit 110 to deflect and change the trajectory of the wellbore 300.

It should be noted that the preset guidance direction can be set before the tool is deployed or preset during drilling by transmitting signals through changes in mud pressure or flow rate. The use of the electric motor or other means to independently drive the valves to achieve opening/closing between the first passage 1431 and the second passage 1432 belongs to an equivalent substitution of the electromagnetic valves 143 described in the present disclosure, and falls within the scope of protection of the present disclosure.

It should be noted that when the technology is used under mine conditions, a drilling rig is disposed in the mine, the main wellbore is a directional well, and the directional well extends from the mine into the formation. The drilling rig is used to drive the power transmission section, and the power transmission section drives the drill bit to rotate through the lateral drilling section with high passing ability. The trajectory-controllable lateral drilling tool can achieve the drilling of the extended well sections of the short to ultra-short radius well section via the short to ultra-short radius well section laterally extending from the main wellbore.

To sum up, according to the short radius drilling tool in Solution 4, due to the arrangement of the steering mechanism, the drill bit can be driven to deflect in an expected direction by the steering mechanism under rotating conditions to change the trajectory of the wellbore, thereby achieving the low directional drilling rate. The electrically driven actuator driving control circuit which contains the large number of power devices and requires the heat dissipation space is disposed in the driving control short pup joint behind the supporting body, which allows only the steering mechanism and the electrically driven actuator to be reserved in the steering pup joint, thus effectively shortening the length of the steering pup joint and further making the directional function more easily achieved in the high curvature wellbores.

The foregoing descriptions are merely illustrative specific implementations of the present disclosure, and are not intended to limit the scope of the present disclosure. Any equivalent changes and modifications made by any person skilled in the art without departing from the concept and principle of the present disclosure shall fall within the scope of protection of the present disclosure.

The invention claimed is:

1. A trajectory-controllable lateral drilling tool comprising a lateral drilling section and a power transmission section, the lateral drilling section is capable of drilling an extension well section of a deviating well section that extends laterally from a main wellbore, and the lateral drilling section sequentially comprises a drill bit, a steering short pup joint, and a transmission short pup joint array from front to back;

the transmission short pup joint array comprises a plurality of transmission short pup joints used to bear torque, the transmission short pup joints are capable of transmitting the rotary drilling power to the drill bit, and a deflection limit is preset between the every two adjacent transmission short pup joints; and the transmission short pup joint array includes a through structure in its own axis direction, and the through structure forms a main flow channel for the circulation of a drilling circulating medium;

wherein:

the steering short pup joint comprises an internally penetrated supporting structure, a hydraulic splitter, an electrical actuator, and one or several hydraulic piston subassemblies fixedly connected to the supporting structure of the steering short pup joint in the circumferential direction; and the electrical actuator is capable of driving the hydraulic splitter to allocate hydraulic fluid to the one or several hydraulic piston subassemblies, and distributing hydraulic fluid to each of the one or several hydraulic piston subassemblies, thereby controlling the hydraulic pressure status of each of the one or several hydraulic piston subassemblies.

2. The trajectory-controllable lateral drilling tool according to claim 1, wherein a relay communication device is disposed between the lateral drilling section and the power transmission section, the relay communication device is electrically connected to an electrical line positioned in the transmission short pup joint array, and at the same time, the relay communication device is capable of communicating with a wellhead end remotely; and the power transmission section comprises a drill pipe, and the outer diameter of the drill pipe is greater than or equal to 50% of the outer diameter of the drill bit.

3. The trajectory-controllable lateral drilling tool according to claim 1, wherein at least one universal joint for variable-angle rotary power transmission is disposed inside each of the transmission short pup joints, and a distance between the every two adjacent universal joints in the transmission short pup joint array is less than 5 times the diameter of the drill bit.

4. The trajectory-controllable lateral drilling tool according to claim 3, wherein a centralizer is disposed at an outer side of the universal joint that is the first one from front to back, or a centralizer is disposed at a section between the drill bit and the universal joint that is the first one from front to back.

5. The trajectory-controllable lateral drilling tool according to claim 1, wherein the hydraulic splitter is a drilling fluid splitter valve, each of the one or several hydraulic piston subassemblies comprises a matched piston cylinder, a piston, and a rib, and the piston and the rib are periodically pushed by high-pressure drilling fluid under the distribution of the hydraulic splitter and radially pushed against the borehole wall along the steering short pup joint so that a resultant force produced by the one or several groups of piston components which respectively push against the borehole wall in their radial directions causes the drill bit to deflect.

6. The trajectory-controllable lateral drilling tool according to claim 5, wherein the hydraulic splitter is disposed at an end portion of the steering short pup joint, and is located at the sides of the one or several hydraulic piston subassemblies close to the drill bit.

7. The trajectory-controllable lateral drilling tool according to claim 1, wherein the trajectory-controllable lateral drilling tool further comprises a directional drilling tool and a straightening device, and the straightening device is capable of allowing the steering short pup joint to be in elastic connection with the transmission short pup joint array coupled to a rear of the steering short pup joint.

8. The trajectory-controllable lateral drilling tool according to claim 1, wherein a measuring device capable of measuring a near-bit attitude is provided in the steering short pup joint, and the measuring device comprises an acceleration sensor and/or a magnetic sensor and/or a gyroscope.

9. The trajectory-controllable lateral drilling tool according to claim 8, wherein the measuring device further comprises a measuring circuit manufactured by using a thick film circuit technology, and the measuring circuit comprises at least one digital chip capable of calculating the tool attitude near the drill bit.

10. The trajectory-controllable lateral drilling tool according to claim 1, wherein transmission rib wings are disposed at an outer side of the supporting structure; the transmission rib wings are hinge jointed to the supporting structure by means of inner hinge structures; the one or several hydraulic piston subassemblies are disposed in front of the inner hinge structures and at the outer side of the supporting structure in a circumferential direction, and is capable of telescopically moving in an annular interstice formed between the supporting structure and the transmission rib wings.

11. The trajectory-controllable lateral drilling tool according to claim 1, wherein a distance "f" from the one or several hydraulic piston subassemblies to a front end face of the drill bit is greater than a distance "j" from the one or several hydraulic piston subassemblies to the frontmost hinge structure; a distance from the front end face of the drill bit to the frontmost hinge structure is not more than 4 times a diameter of the drill bit; and a length of a gauge protection section of the drill bit is not less than 10% of the diameter of the drill bit.

12. A trajectory-controllable lateral drilling method, wherein the trajectory-controllable lateral drilling tool according to claim 1, is employed by the method, and the trajectory-controllable lateral drilling method comprises the following steps:

step 1: under the condition that a deflection tool comprises a flexible drill rod and a high directional drilling bit, using a conventional drill pipe to drive the high directional drilling bit to complete the lateral drilling of the deviating well section by means of the flexible drill rod with a certain length under the actions of an oblique force provided by a directional tool and WOB, wherein lengths of the flexible drill rod and the high directional drilling bit are not less than a length of the deviating well section; and step 2: retrieving the flexible drill rod and the high directional drilling bit, and inserting the trajectory-controllable lateral drilling tool to traverse the deviating well section so as to complete the drilling of an extended well section, wherein the directional tool is capable of supporting the trajectory-controllable lateral drilling tool in a main wellbore, and a length of the lateral drilling section is greater than the sum of the length of the deviating well section and a wellbore length of the extended well section.

13. A trajectory-controllable lateral drilling tool comprising a lateral drilling section and a power transmission section, the lateral drilling section is capable of drilling an extension well section of a deviating well section that extends laterally from a main wellbore, and the lateral drilling section sequentially comprises a drill bit, a steering short pup, and a transmission short pup joint array from front to back;

the transmission short pup joint array comprises a plurality of transmission short pup joints used to bear torque, the transmission short pup joints are capable of transmitting the rotary drilling power to the drill bit, and a deflection limit is preset between the every two adjacent transmission short pup joints; and the transmission short pup joint array includes a through structure in its own axis direction, and the through structure forms a main flow channel for the circulation of a drilling circulating medium;

wherein a relay communication device is disposed between the lateral drilling section and the power transmission section, the relay communication device is electrically connected to an electrical line positioned in the transmission short pup joint array, and at the same time, the relay communication device is capable of communicating with a wellhead end remotely; and the power transmission section comprises a drill pipe having an outer diameter greater than or equal to 50% of the outer diameter of the drill bit;

wherein a measuring device is disposed in the steering short pup joint, the measuring device comprises a formation information measuring module, the formation information measuring module comprises at least a gamma sensor, the gamma sensor is fixedly disposed inside any of the transmission short pup joints, and the gamma sensor is electrically connected to the relay communication device, so that the measuring device transmits measured formation information to a ground display device via the relay communication device.

14. The trajectory-controllable lateral drilling tool according to claim 13, wherein the steering short pup joint comprises an internally penetrated supporting structure, a hydraulic splitter, an electrical actuator and one or several hydraulic piston subassemblies fixedly connected to the supporting structure of the steering short pup joint in the circumferential direction; and the electrical actuator is capable of driving the hydraulic splitter to allocate hydraulic fluid to the one or several hydraulic piston subassemblies, and distributing hydraulic fluid to each of the one or several hydraulic piston subassemblies, thereby controlling the hydraulic pressure status of each of the one or several hydraulic piston subassemblies.

15. A trajectory-controllable lateral drilling tool comprising a lateral drilling section and a power transmission section, the lateral drilling section is capable of drilling an extension well section of a deviating well section that extends laterally from a main wellbore, and the lateral drilling section sequentially comprises a drill bit, a steering short pup, and a transmission short pup joint array from front to back;

the transmission short pup joint array comprises a plurality of transmission short pup joints used to bear torque, the transmission short pup joints are capable of transmitting the rotary drilling power to the drill bit, and a deflection limit is preset between the every two adjacent transmission short pup joints; and the transmission short pup joint array includes a through structure in its own axis direction, and the through structure forms a main flow channel for the circulation of a drilling circulating medium;

wherein a power supply joint is also disposed behind the transmission short pup joint array, the power supply joint comprises a battery and a downhole generator, and the power supply joint is electrically connected to the steering short pup joint by means of the electrical line, so that the power supply for the electrical actuator in the steering short pup joint is realized.

16. A short radius drilling tool, comprising:

a steering short pup joint, comprising a drill bit and a steering pup joint, wherein the steering pup joint comprises a supporting body, the supporting body is provided with a steering mechanism and an electrically driven actuator, the drill bit is connected to a lower end of the supporting body, and the steering mechanism is capable of driving the drill bit to deflect in an expected direction;

a drive drill pipe comprising a plurality of supporting short pup joints connected sequentially from top to bottom, the lowermost supporting short pup joint is connected to the supporting body, every two adjacent supporting short pup joints are hinge jointed to each other by means of a WOB and torque deflection transfer mechanism, and the supporting short pup joints are also hinge jointed to the supporting body by means of the WOB and torque deflection transmission mechanism;

a driving control short pup joint, provided with an electrically driven actuator driving control circuit, wherein the electrically driven actuator driving control circuit is electrically connected to the electrically driven actuator by means of a crossover cable, and the driving control short pup joint is connected between the steering short pup joint and the drive drill pipe; alternatively, the driving control short pup joint is connected to any position in the drive drill pipe; alternatively, the driving control short pup joint is connected to an upper end of the drive drill pipe; and lengths of the supporting short pup joints are less than 1.2 m.

17. The short radius drilling tool according to claim 16, wherein the steering mechanism comprises at least one group of driving hydraulic cylinders disposed at intervals in the circumferential direction of the supporting body, and each of the driving hydraulic cylinders comprises a piston cylinder connected to a shell of the supporting body, and a driving piston disposed inside the piston cylinder; the driving pistons are capable of abutting against the borehole wall; and the drill bit is driven to deflect in an expected direction by the telescopic movement of the driving piston.

18. The short radius drilling tool according to claim 17, wherein an upper end of the drill bit is coaxially connected to a transmission lever, the transmission lever is connected to a lower portion of the supporting body by means of a controllable universal joint, and a interstice is formed between the transmission lever and the supporting body; the steering mechanism is disposed in the interstice and located above the controllable universal joint; and the driving pistons are capable of abutting against the hole-wall by means of the transmission lever, the transmission lever is driven to rotate around a center of the controllable universal joint by the telescopic movement of the driving pistons, and the drill bit is driven to deflect in an expected direction by the rotation of the transmission lever.

19. The short radius drilling tool according to claim 17, wherein the electrically driven actuator comprises a rotary valve and a driving motor, a through-flow channel is provided in the supporting body, the rotary valve is capable of enabling the through-flow channel to be periodically connected to the driving hydraulic cylinders, and the driving motor is electrically connected to the electrically driven actuator driving control circuit.

20. The short radius drilling tool according to claim 19, wherein the rotary valve comprises a rotary valve rotor and a rotary valve stator, the rotary valve stator is fixedly connected to the supporting body, the rotary valve stator has a plurality of valve positions corresponding to the driving hydraulic cylinders on a one-to-one basis, the driving motor comprises a driving motor rotor and a driving motor stator, and the driving motor stator is fixedly connected to the supporting body; and the rotary valve rotor and the driving motor rotor are coupled to each other, and the driving motor rotor is capable of driving the rotary valve rotor to rotate relative to the rotary valve stator.

21. The short radius drilling tool according to claim 17, wherein the through-flow channel is provided in the supporting body, the electrically driven actuator comprises a plurality of electromagnetic valves, each of which corresponds to a respective driving hydraulic cylinder, each of the electromagnetic valves is electrically connected to the electrically driven actuator driving control circuit, each of the electromagnetic valves has a first passage and a second passage, the first passages are connected to the driving hydraulic cylinders, the second passages are connected to the through-flow channel, and the electromagnetic valves are capable of enabling the through-flow channel to be periodically connected to the driving hydraulic cylinders.

22. The short radius drilling tool according to claim 16, wherein the electrically driven actuator driving control circuit comprises at least one ring-shaped switch tube carrying circuit board, and at least one ring-shaped switch tube driver carrying circuit board, the switch tube carrying circuit board is provided with a switch tube, the switch tube driver carrying circuit board is provided with a switch tube driver, and the switch tube is electrically connected to the switch tube driver.

23. The short radius drilling tool according to claim 16, wherein the short radius drilling tool further comprises a strapdown attitude measurement module and a guidance control circuit, the strapdown attitude measurement module is fixedly disposed in the short radius drilling tool, and the strapdown attitude measurement module is capable of measuring a hole deviation angle and/or gravity tool face angle and/or magnetic tool face angle of the short radius drilling tool underground; the guidance control circuit is separately and electrically connected to the strapdown attitude measurement module and the electrically driven actuator driving control circuit; and the guidance control circuit is capable of controlling the electrically driven actuator to perform instructed movements based on detection data of the strapdown attitude measurement module.

* * * * *